US005903284A

United States Patent [19]

Sato

[11] Patent Number: 5,903,284

[45] Date of Patent: May 11, 1999

[54] SHEET SORTING APPARATUS WITH MEMORY FOR SORTING OR STORAGE POSITION DATA

[75] Inventor: Shunji Sato, Yokohama, Japan

[73] Assignee: Canon Kabushiki Kaisha, Tokyo, Japan

[21] Appl. No.: 08/900,758

[22] Filed: Jul. 28, 1997

Related U.S. Application Data

[63] Continuation of application No. 07/801,588, Dec. 4, 1991, abandoned, which is a continuation of application No. 07/320,801, Mar. 9, 1989, abandoned, which is a continuation of application No. 06/802,430, Nov. 27, 1985, abandoned.

[30] Foreign Application Priority Data

| | | | |
|---|---|---|---|
| Nov. 30, 1984 | [JP] | Japan | 59-253301 |
| Nov. 30, 1984 | [JP] | Japan | 59-253302 |
| Nov. 30, 1984 | [JP] | Japan | 59-253303 |
| Nov. 30, 1984 | [JP] | Japan | 59-253304 |
| Nov. 30, 1984 | [JP] | Japan | 59-253305 |
| Nov. 30, 1984 | [JP] | Japan | 59-253306 |
| Nov. 30, 1984 | [JP] | Japan | 59-253307 |
| Nov. 30, 1984 | [JP] | Japan | 59-253308 |
| Nov. 30, 1984 | [JP] | Japan | 59-253309 |
| Nov. 30, 1984 | [JP] | Japan | 59-253310 |
| Nov. 30, 1984 | [JP] | Japan | 59-253311 |
| Nov. 30, 1984 | [JP] | Japan | 59-253312 |

[51] Int. Cl.[6] ..... B65H 43/00

[52] U.S. Cl. ..... 346/134; 271/287; 271/289; 271/290

[58] Field of Search ..... 271/290, 296, 271/269, 289, 287; 346/134; 399/16, 13, 369, 405

[56] References Cited

U.S. PATENT DOCUMENTS

| | | | |
|---|---|---|---|
| 3,924,846 | 12/1975 | Reed | 270/56 |
| 3,944,794 | 3/1976 | Reehil et al. | 235/925 B |
| 4,201,464 | 5/1980 | Botte et al. | 355/14 R |
| 4,229,100 | 10/1980 | Tranis | 355/77 X |
| 4,332,462 | 6/1982 | Yagasaki et al. | 355/14 R |
| 4,370,052 | 1/1983 | Murakami et al. | 355/14 R |
| 4,439,865 | 3/1984 | Kikuchi et al. | 270/58 X |
| 4,442,505 | 4/1984 | Takano | 364/900 |
| 4,515,464 | 5/1985 | Shigemura et al. | 355/14 R |
| 4,521,102 | 6/1985 | Motomura et al. | 355/14 CU |
| 4,521,847 | 6/1985 | Ziehm et al. | 364/184 |
| 4,556,310 | 12/1985 | Masuda | 355/14 R |
| 4,579,446 | 4/1986 | Fujino et al. | 355/24 |
| 4,603,850 | 8/1986 | Horiuchi | 271/298 |
| 4,641,954 | 2/1987 | Miyata et al. | 355/14 R |
| 4,750,731 | 6/1988 | Dei et al. | 271/290 |

FOREIGN PATENT DOCUMENTS

| | | | |
|---|---|---|---|
| 56-146053 | 11/1981 | Japan . | |
| 59-78373 | 5/1984 | Japan . | |
| 2059395 | 4/1981 | United Kingdom | 271/290 |

*Primary Examiner*—Huan Tran
*Attorney, Agent, or Firm*—Fitzpatrick, Cella, Harper & Scinto

[57] ABSTRACT

A sheet sorting apparatus is equipped with a control device for controlling the sorting of sheets from a sheet processing device and a memory for storing data concerning the number of sorted sheets. The memory has a back-up power source that is independent of the sheet processing device which discharges sheets to the sorter and includes a transmitter for transmitting the data stored in the memory to this upstream sheet processing device.

6 Claims, 30 Drawing Sheets

FIG. 5-1

COPYING APPARATUS → SORTER 1
SORTER 1 → SORTER 2

TRANSMISSION DATA

| | MSB 7 | 6 | 5 | 4 | 3 | 2 | 1 | LSB 0 |
|---|---|---|---|---|---|---|---|---|
| 1st FIELD | 0 | 0 | 0 | REQ | BSFT | BCR | PDP | SSTRT |
| | 1st FLD DESIG. | | | | | | | |
| 2nd FIELD | 0 | 0 | 1 | | | | | |
| | 2nd FLD DESIG. | | | | | SORTER OPERATION MODE SIGNAL | | |
| 3rd FIELD | 0 | 1 | 0 | | | | | |
| | 3rd FLD DESIG. DATA DISCR BIT | | | | DATA OF COPY SET NUMBER OF SHEETS, OR COPY SHEET SIZE DATA | | | |
| 4th FIELD | 0 | 1 | 1 | | | | | |
| | 4th FLD DESIG. | | | | DATA OF COPY SET NUMBER OF SHEETS | | | |
| 5th FIELD | 1 | 0 | 0 | | | | | |
| | 5th FLD DESIG. | | | | DATA OF COPY SET NUMBER OF SHEETS | | | |
| 6th FIELD | 1 | 0 | 1 | | | | | |
| | 6th FLD DESIG. | | | | DESIG. RAM ADDRESS | | | |
| 7th FIELD | 1 | 1 | 0 | | | | | |
| | 7th FLD DESIG. | | | | DESIG. RAM ADDRESS | | | |
| 8th FIELD | 1 | 1 | 1 | 1 | 1 | 1 | 1 | 1 |
| | 8th FLD DESIG. | | | ERROR CODE | | | | |

FIG. 5-2

| | SIGNAL NAME | | MEANING · FUNCTION |
|---|---|---|---|
| COPYING APPARATUS ⇨ SORTER 1 | SSTRT | SORTER · START SIGNAL | SORTER · START |
| | PDP | COPY SHEET OUTPUT SIGNAL | INFORMING THAT COPY SHEET IS ON SHEET OUTPUT SENSOR OF COPYING APPARATUS |
| | BCR | BIN RETURN SIGNAL | RETURNNING BIN TO HOME POSITION |
| | BSFT | BIN SHIFT SIGNAL | SHIFTING BIN |
| | REQ | REQUEST SIGNAL | OUTPUTING THIS SIGNAL AT THE TIME OF JAM IN MAIN BODY, AND RECEIVING THE NUMBER OF SHEETS STORED IN SORTER |
| SORTER 1 ⇨ SORTER 2 | | SORTER OPERATION MODE SIGNAL | SENDING OPERATION MODE OF SORTER SELECTED BY COPYING APPARATUS TO THE SORTER |
| | | SIGNAL OF COPY SET NUMBER OF SHEETS | SENDING THE NUMBER OF COPY SHEETS SET BY COPYING APPARATUS TO SORTER |
| | | COPY SHEET SIZE SIGNAL | SENDING COPY SHEET SIZE SELECTED BY COPYING APPARATUS TO SORTER |
| | | DESIG. RAM ADDRESS SIGNAL | SENDING RAM ADDRESS (LSD 8BITS) AT SIDE OF SORTER CONTROL MICON SELECTED BY COPYING APPARATUS TO THE SORTER |

FIG. 6-1

SORTER 1 → COPYING APPARATUS
SORTER 2 → SORTER 1

TRANSMISSION DATA

| | MSB 7 | 6 | 5 | 4 | 3 | 2 | 1 | LSB 0 |
|---|---|---|---|---|---|---|---|---|
| 1st FIELD | 0 | 0 | 0 | RSRT | OSRT | ALARM | SJAM | SSTBY |
| | 1st FLD DESIG. | | | | | | | |
| 2nd FIELD | 0 | 0 | 1 | | | | | |
| | 2nd FLD DESIG. | | | | | | | |
| 3rd FIELD | 0 | 1 | 0 | | | | | |
| | 3rd FLD DESIG. | | | DATA DISCR BIT | DATA OF THE TOTAL NUMBER OF BINS OF SORTER OR DATA OF THE NUMBER OF SHEETS STORED IN SORTER | | | |
| 4th FIELD | 0 | 1 | 1 | | | | | |
| | 4th FLD DESIG. | | | DATA DISCR BIT | DATA OF THE TOTAL NUMBER OF BINS OF SORTER OR DATA OF THE NUMBER OF SHEETS STORED IN SORTER | | | |
| 5th FIELD | 1 | 0 | 0 | | | | | |
| | 5th FLD DESIG. | | | DATA DISCR BIT | DATA OF THE TOTAL NUMBER OF BINS OF SORTER OR DATA OF THE NUMBER OF SHEETS STORED IN SORTER | | | |
| 6th FIELD | 1 | 0 | 1 | | | | | |
| | 6th FLD DESIG. | | | | DESIG. RAM DATA | | | |
| 7th FIELD | 1 | 1 | 0 | | | | | |
| | 7th FLD DESIG. | | | | DESIG. RAM DATA | | | |
| 8th FIELD | 1 | 1 | 1 | 1 | 1 | 1 | 1 | 1 |
| | 8th FLD DESIG. | | | ERROR CODE | | | | |

FIG. 6-2

| | SIGNAL NAME | | MEANING · FUNCTION |
|---|---|---|---|
| COPYING APPARATUS ⇨ SORTER 1 | SSTBY | SORTER STANDBY SIGNAL | INFORMING COPIER THAT SORTER IS IN OPERABLE CONDITION |
| | SJAM | SORTER · JAM SIGNAL | INFORMING COPIER OF OCCURRENCE OF JAM IN SORTER |
| | ALARM | ALARM SIGNAL | INFORMING COPIER THAT SORTER IS IN INOPERABLE CONDITION BECAUSE SORTER IS NOT CONNECTED WITH COPIER |
| SORTER 1 ⇨ SORTER 2 | OSRT | OLD · ORIGINAL SORTING SIGNAL | INFORMING COPIER OF A CONDITION THAT COPY SHEET ON PREVIOUS ORIGINAL IS NOT COMPLETELY OUTPUTTED TO BIN, WHILE COPIER IS IN COPYING OPERATION ON NEW ORIGINAL |
| | RSRT | REVERSE SORTING SIGNAL | INFORMING COPIER OF REVERSE SORTING |
| | | SIGNAL OF THE TOTAL NUMBER OF BINS OF SORTER | INFORMING COPIER OF THE TOTAL NUMBER OF BINS OF SORTER |
| | | SIGNAL OF THE NUMBER OF SHEETS STORED IN SORTER | INFORMING COPIER OF THE NUMBER OF COPY SHEETS STORED IN BINS OF SORTER, ON WHICH COPY SHEETS COPYING HAS BEEN PERFORMED ON THE SAME ORIGINAL |
| | | DESIG. RAM DATA SIGNAL | SENDING RAM DATA REPRESENTED BY DESIGNATION RAM ADDRESS TO COPIER |

FIG. 7-1
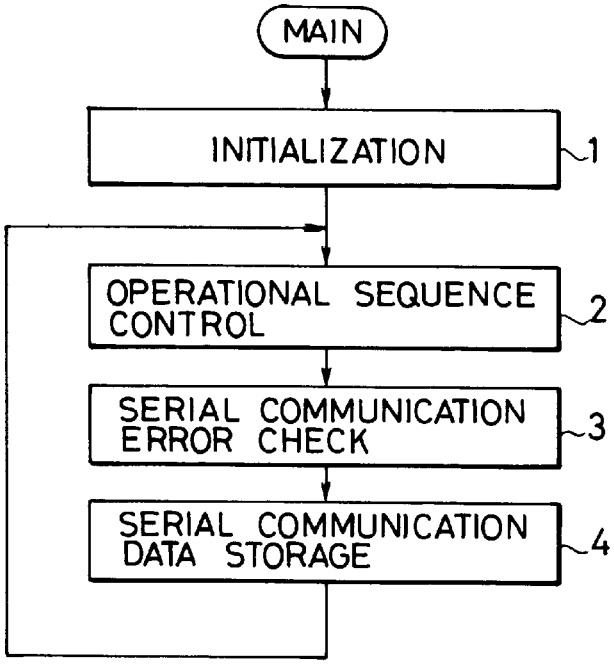
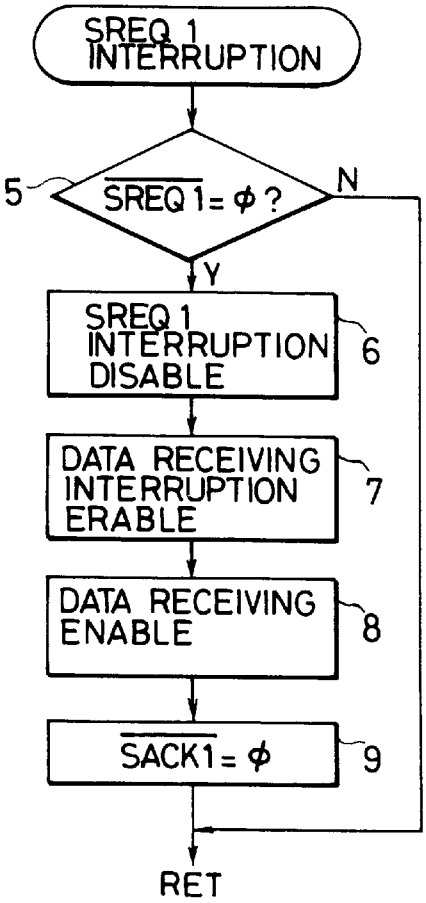
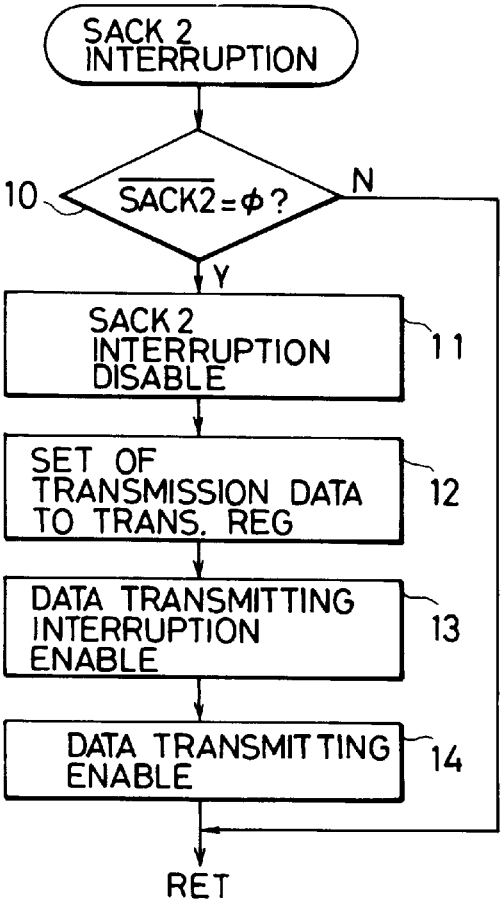

1

2

COLLATING MODE (TWO ORIGINALS, THREE COPY SHEETS)

SHEET SORTING APPARATUS WITH MEMORY FOR SORTING OR STORAGE POSITION DATA

This continuation of application Ser. No. 07/801.588, filed Dec. 4, 1991, now abandoned, which is a continuation of application Ser. No. 07/320.801, filed Mar. 9, 1989, now abandoned, which is a continuation of application Ser. No. 06/802,430, filed Nov. 27, 1985, now abandoned.

BACKGROUND OF THE INVENTION

1. Field of the Invention

The present invention relates to a device for controlling a sheet handling apparatus or the like.

2. Description of the Prior Art

Peripheral apparatus such as sorters for sorting and storing recorded sheets or automatic original feeders for handling original documents to be copied are often connected to an image recording apparatus such as a copying machine, and the operation of these apparatus is controlled by communication of data and various signals between said image recording apparatus and peripheral apparatus.

Conventionally control signals for communication between the sorters and the copying machine are transmitted through separate parallel lines, so that the number of control signal lines has to be increased when plural sorters are connected.

Also in case of increasing the number of control signals and data transmitted between the copying machine and the sorters for achieving multiple functions therein, the number of signal lines in such parallel system is inevitably limited for example due to a limitation in the number of ports of the controlling microcomputer.

Also it has been difficult for the operator to confirm whether the data are securely transmitted among various units.

Furthermore, it has been difficult for the operator to determine whether a malfunction has been caused by a hardware error or by a communication error.

Furthermore, if copying of a number exceeding the processing capacity of peripheral apparatus such as sorters or collaters is commanded, the copies exceeding said capacity are treated as if such peripheral apparatus are absent and have to be manually sorted, so that the sorters are unable to improve the efficiency.

Furthermore, in such communication system, an erroneous function of the apparatus may occur due to an error in the communication, for example due to start characteristics of the power supply, if communication is started immediately after the start of power supply.

Conventionally, in copying operation with such sorters attached to the copying machine, the number of sheets is counted with a sensor provided at the exit of the copying machine. In case the copying operation is interrupted by a trouble in sheet transportation such as jamming in a sheet path from the copying machine to the sorters, the copies lost in such jamming are replenished in the re-started copying operation based on said count.

However, in such counting method, a copy which has passed the exit part of the copying machine is considered to be properly transported, so that any sheet jammed in the sorters cannot be compensated and the number of obtained copies becomes erroneous.

Furthermore, there is already known a sheet handling apparatus in which plural storage bins are transported in succession to a sheet transport position to sort and store sheets discharged from the image recording apparatus such as copying machine. If such apparatus is provided with plural home positions and if bins are stopped out of such home positions, the bins have to be moved to one of such plural home positions prior to being moved to a main home position, so that an additional time is required for movement to said main home position.

There is further known such apparatus in which sheets are stored in plural bins in a determined order and then in inverted order. In such apparatus, if the number of sheets obtained in a job, for example of obtaining a preset number of copies from an original and storing said copies in plural bins in a determined order, is deficient or excessive, a malfunction in the sheet storage occurs by the storage of sheets in a succeeding job in the inverted order.

SUMMARY OF THE INVENTION

In consideration of the foregoing, an object of the present invention is to provide an improved sheet handling apparatus.

Another object of the present invention is to provide a sheet handling apparatus allowing connection in plural units with a simple structure and without an increase in the number of signal lines.

Still another object of the present invention is to provide a sheet handling apparatus capable of preventing erroneous function resulting from an error in communication.

Still another object of the present invention is to provide a sheet handling apparatus capable of watching the interval of communication with a master unit and enabling communication with a slave unit in case of a communication error during a sheet handling operation.

Still another object of the present invention is to provide a sheet handling apparatus capable of securely grasping the processing capacity of the peripheral apparatus.

Still another object of the present invention is to provide a sheet handling apparatus enabling the operator to know whether a malfunction of the apparatus is caused by a failure in hardware or an error in communication.

Still another object of the present invention is to provide a sheet handling apparatus capable of monitoring the control status of the apparatus with a simple structure.

Still another object of the present invention is to provide a sheet handling apparatus allowing to securely obtain a desired number of image-bearing sheets even in case of a failure in the sheet transportation.

Still another object of the present invention is to provide a sheet handling apparatus allowing rapid return to a reference position, even in case of an interruption in the power supply, after the power supply is restored.

Still another object of the present invention is to provide a sheet handling apparatus with widened applications.

Still another object of the present invention is to provide a sheet handling apparatus allowing secure sorting and storage of sheets.

The foregoing and still other objects of the present invention will become apparent from the following description.

BRIEF DESCRIPTION OF THE DRAWINGS

FIG. 2-1 is a block diagram showing control units of the copying machine and the sorters 1 and 2;

FIG. 2-2 is a plan view showing a display-operation unit of the copying machine;

FIGS. 2-3 and 2-4 are plan views showing display units of the sorters 1 and 2;

FIG. 3-1 is a block diagram showing the details of the control unit of the sorter;

FIG. 3-2 is a chart showing the relation of the resistance of a variable resistor for setting the sheet transport speed, to the duty ratio of driving pulses of a sheet transport motor;

FIG. 4 is a chart showing the timing and format of asynchronous serial communication;

FIGS. 5-1, 5-2, 6-1 and 6-2 are charts showing the structure of field data and meaning and function of control signals;

FIGS. 7-1 to 7-11 are flow charts showing control procedures for asynchronous serial communication according to the present invention;

FIG. 8-1 is a schematic view showing the function of the sorter in a non-sorting mode;

FIG. 8-2 is a timing chart of the non-sorting mode;

FIG. 9-1 is a schematic view showing the function of the sorter in a sorting mode;

Figure 1:
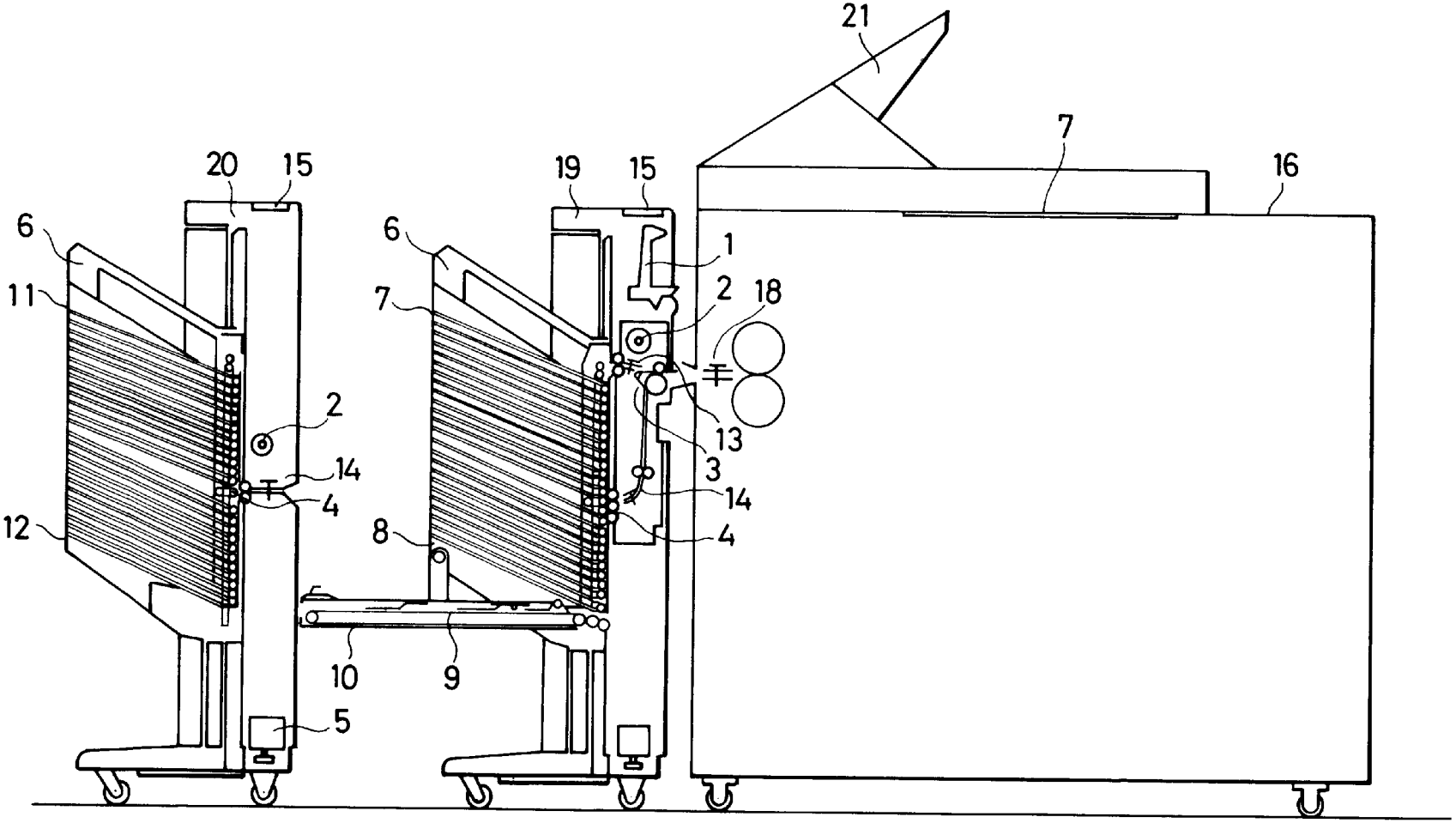
FIG. 1 is a view showing connection of a copying machine with an automatic original feeder and sorters.
Figures 1, 2:
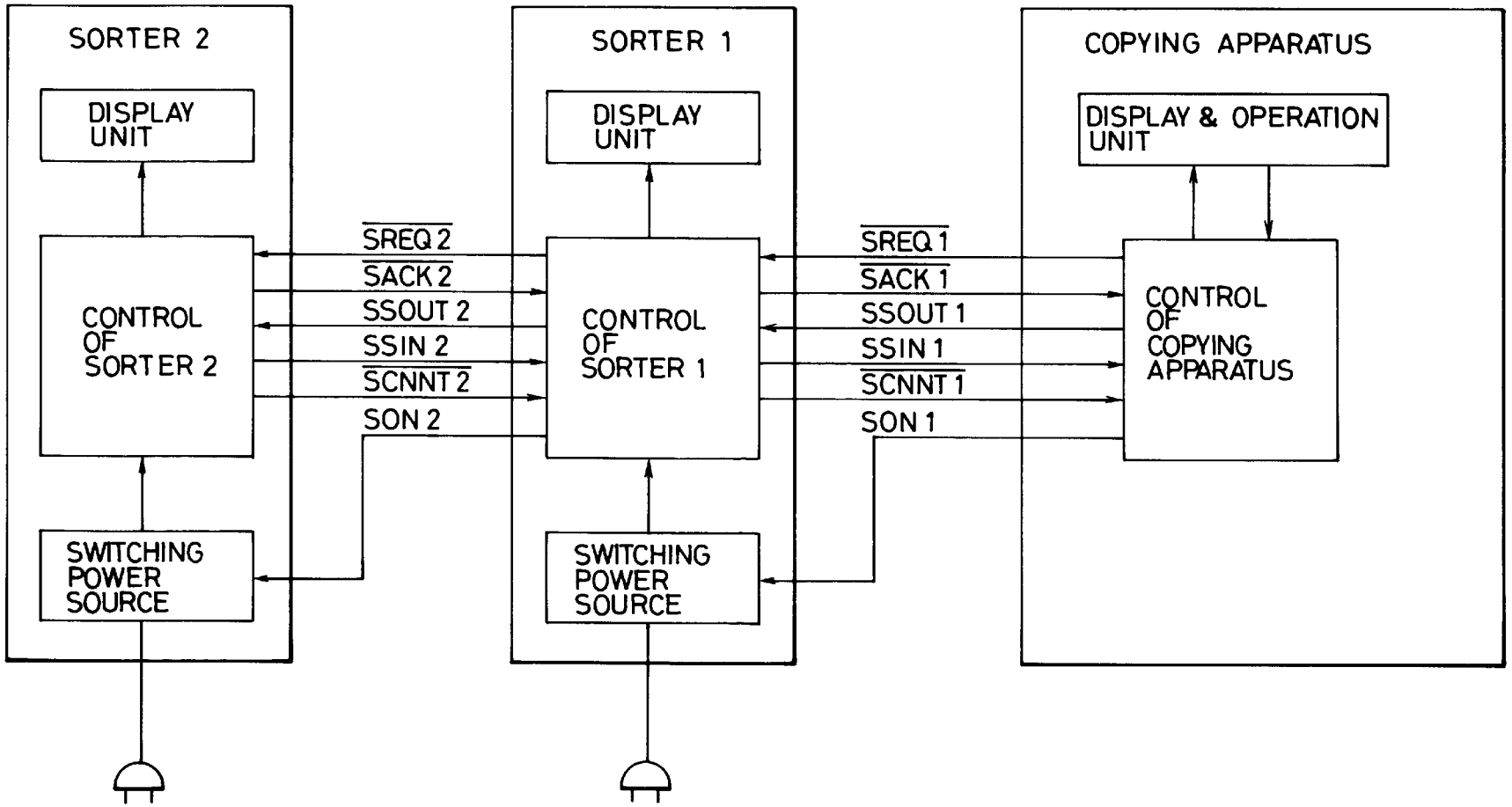
Figure 2:
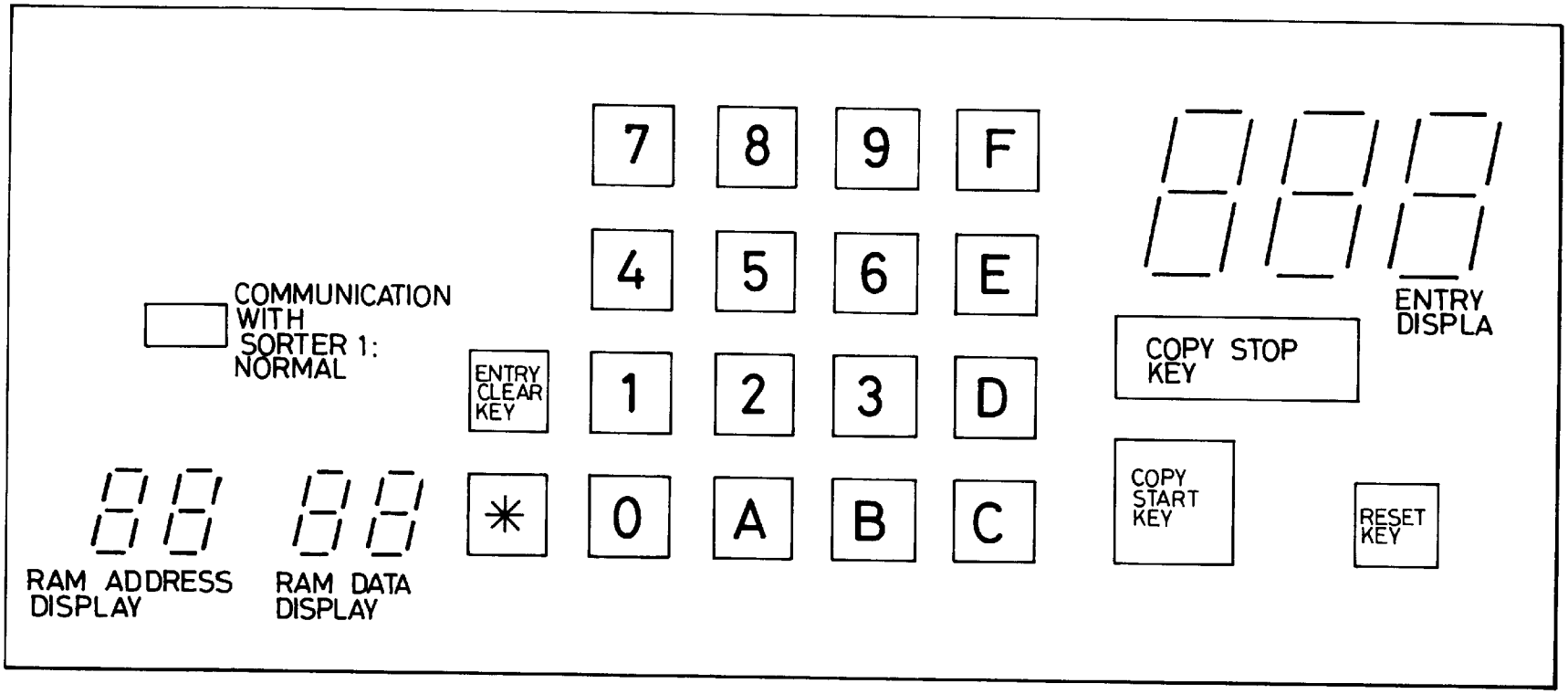
Figures 2A, 7:
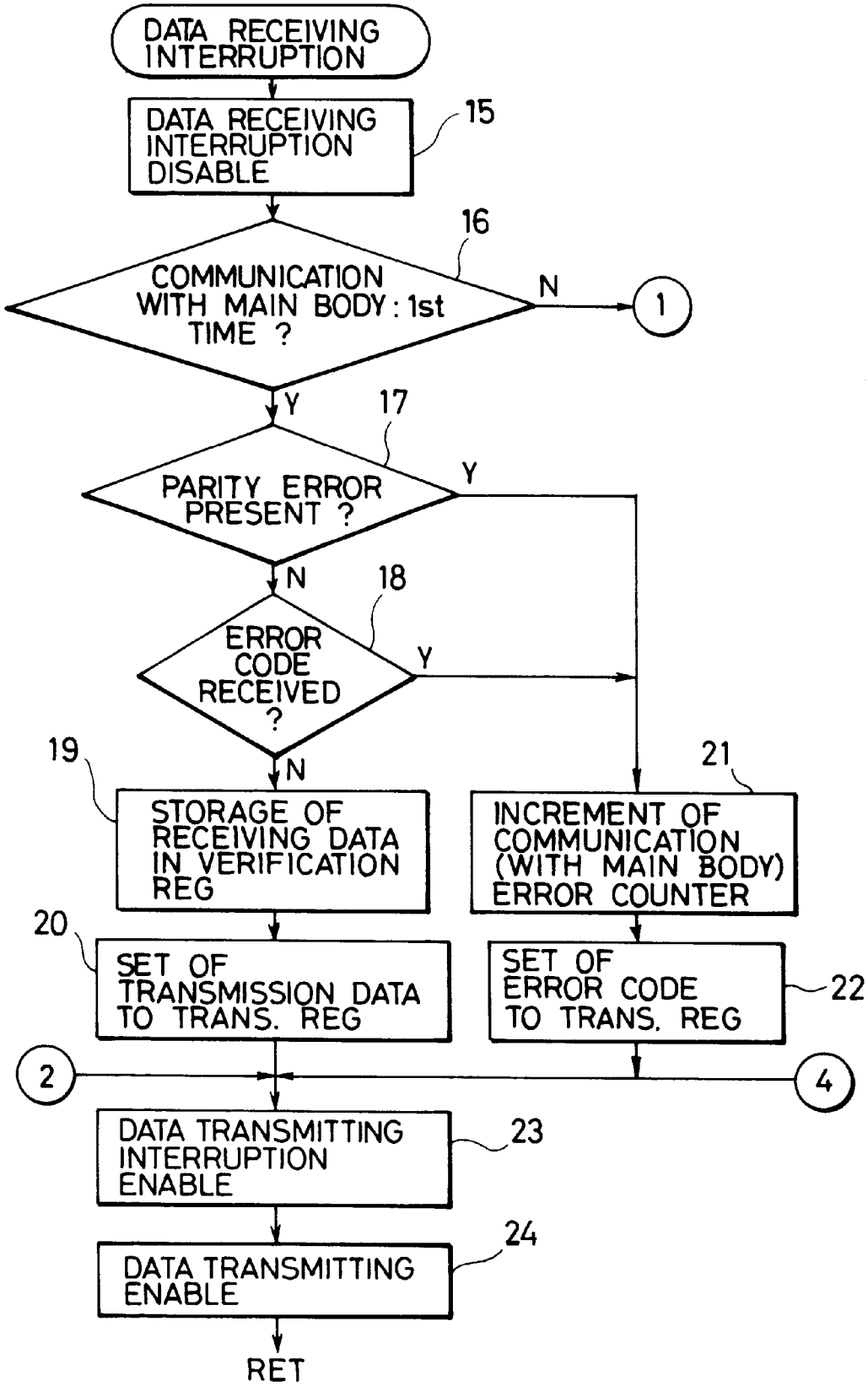
Figures 2B, 7:
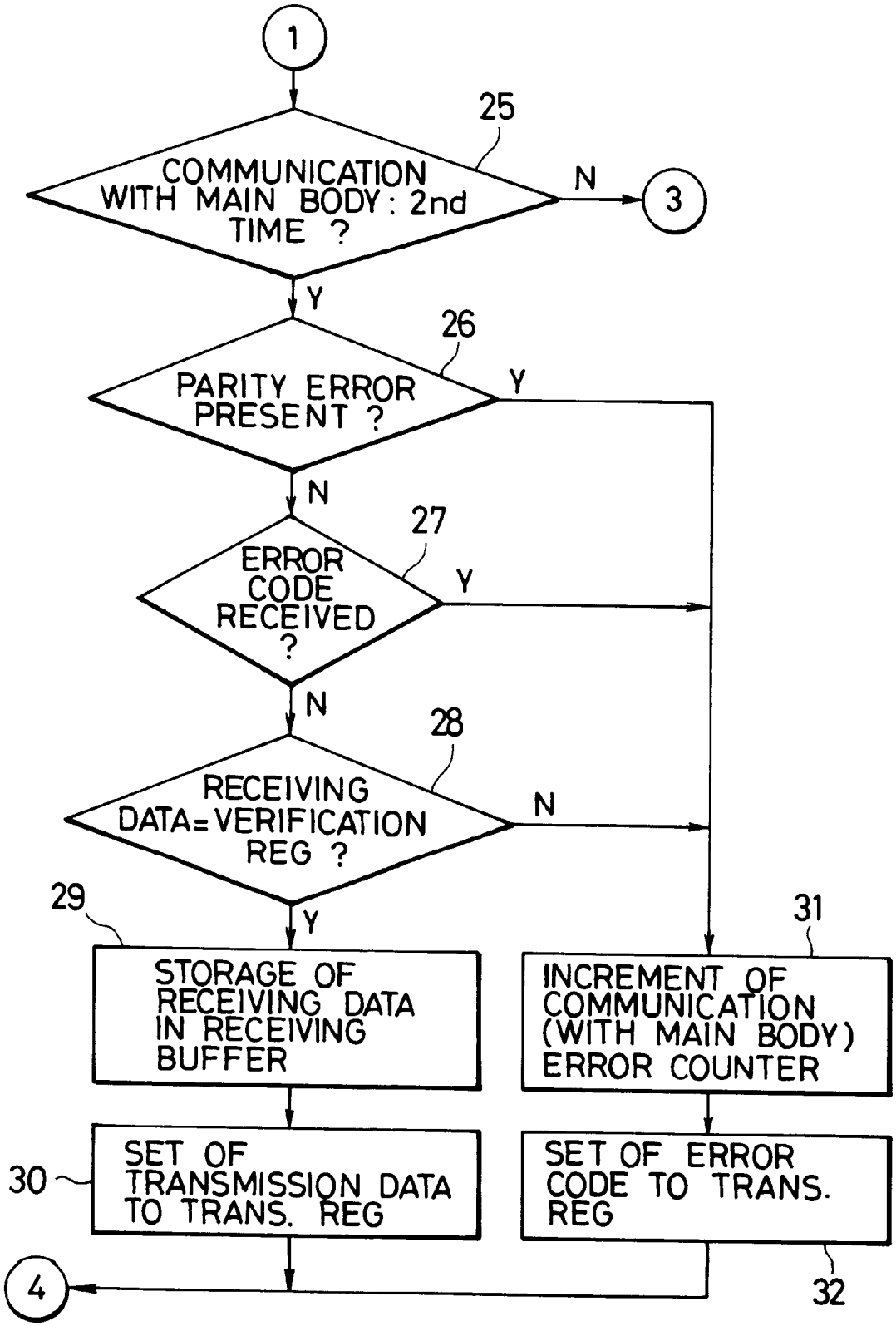
Figures 3, 7:
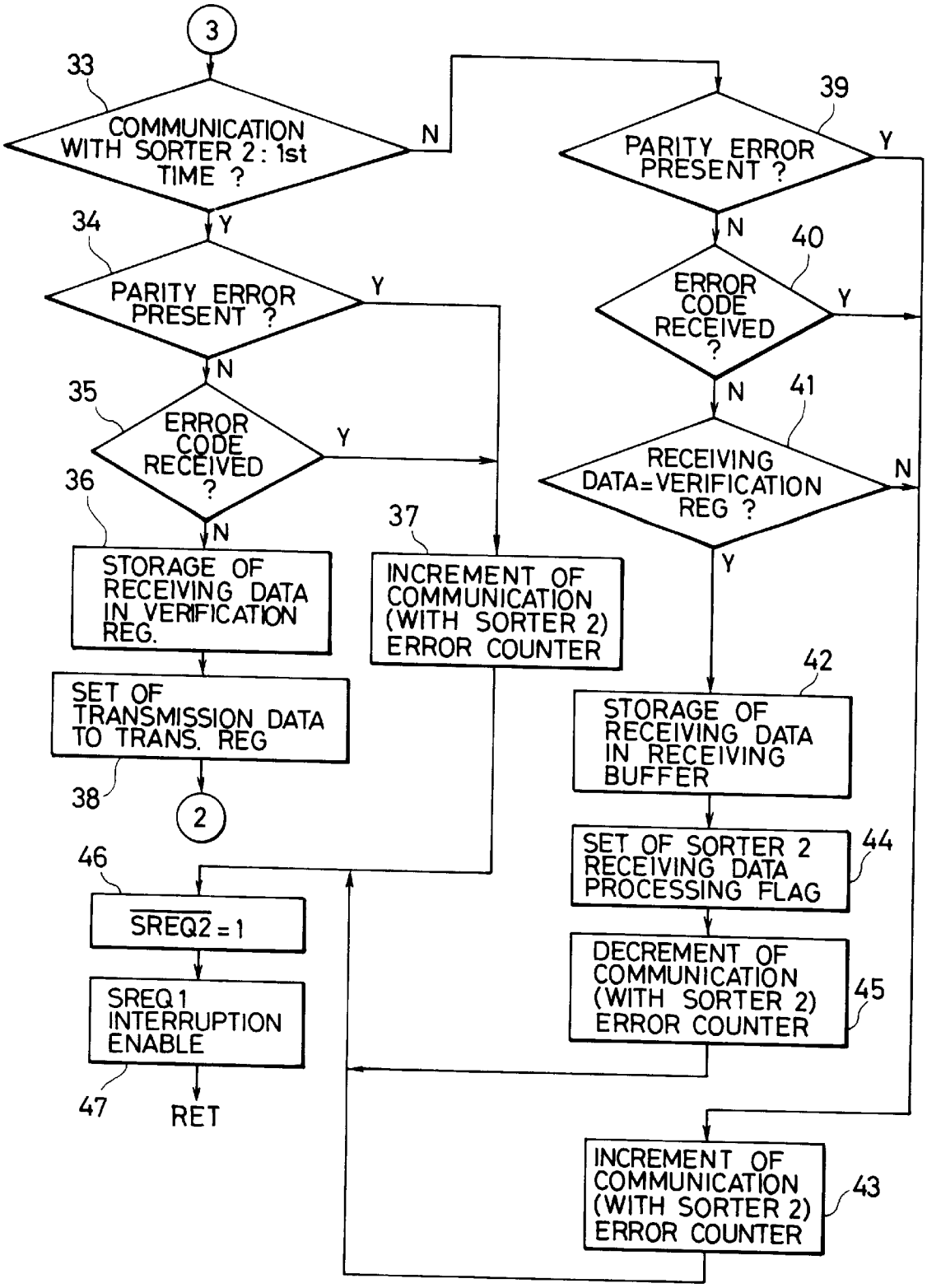
Figures 4, 7:
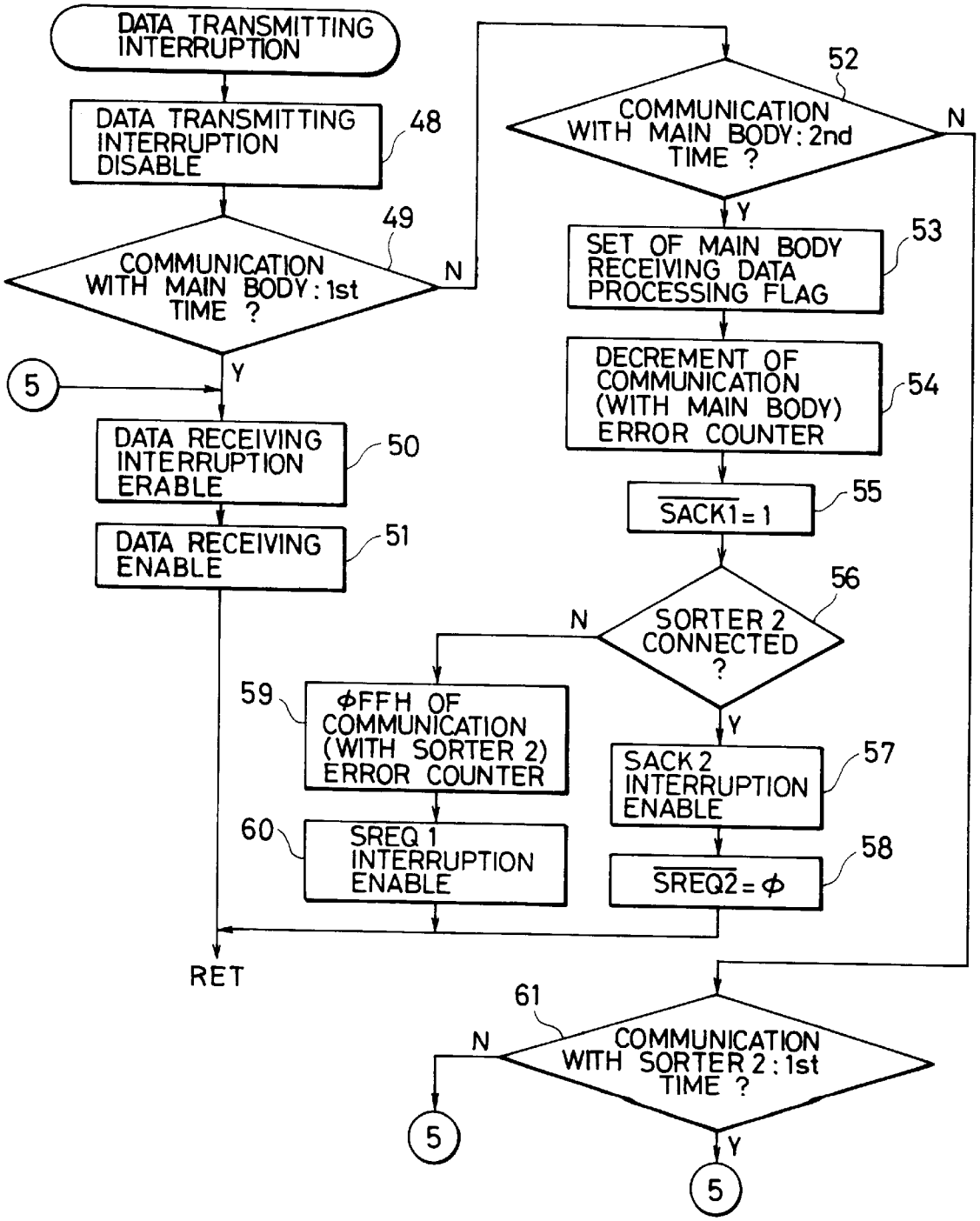
Figures 5, 7:
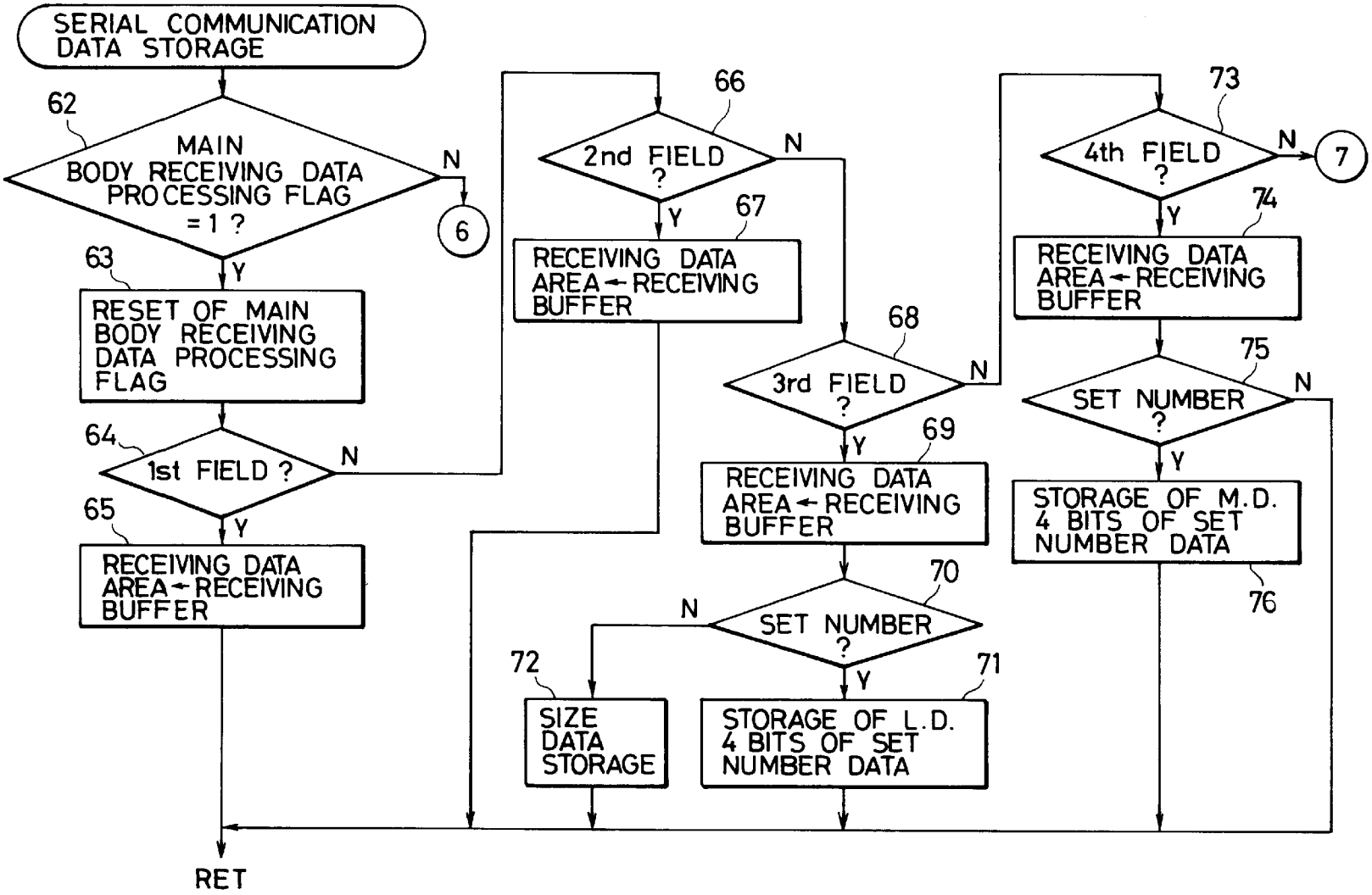
Figures 6, 7:
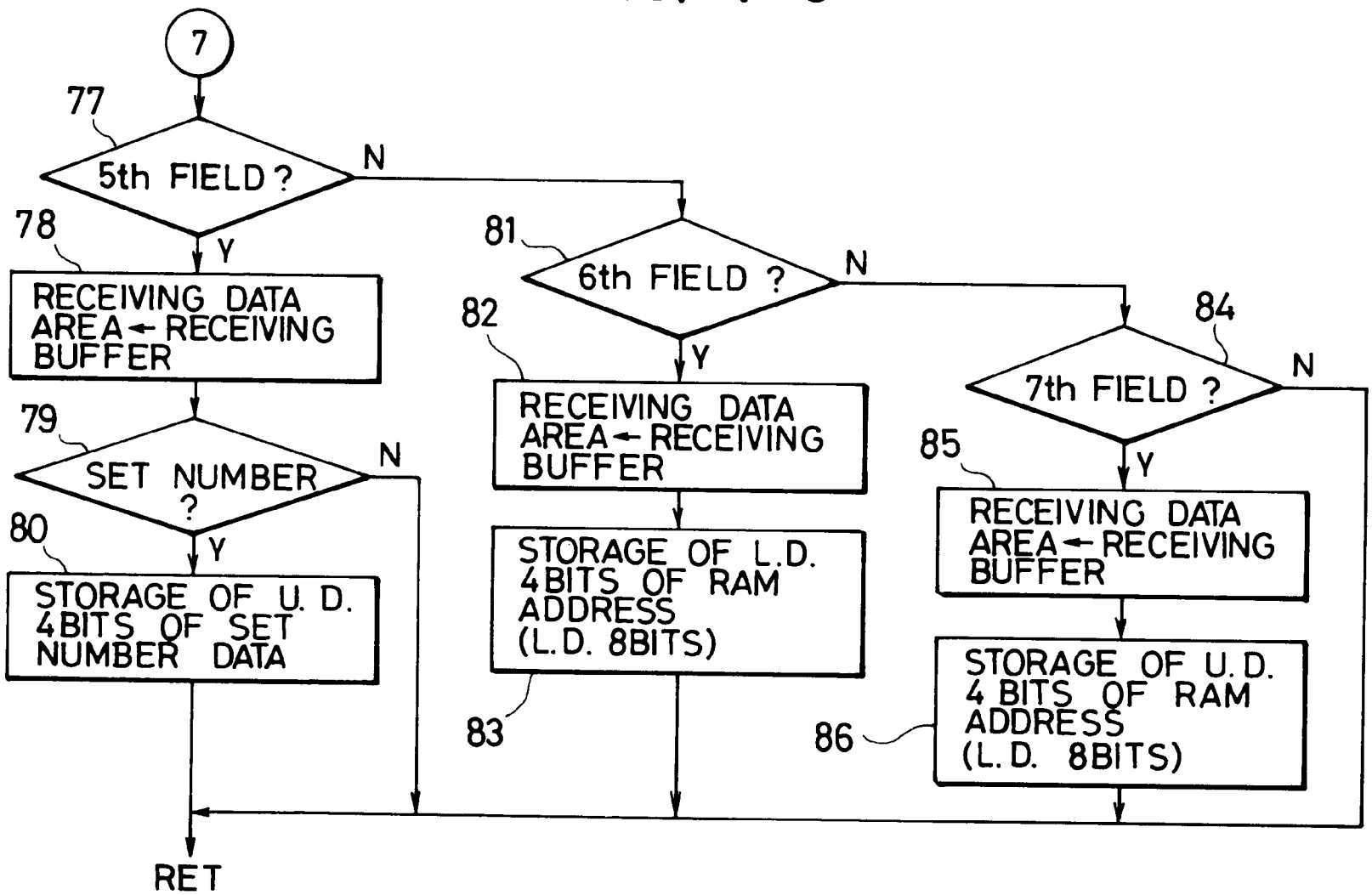
Figure 7:
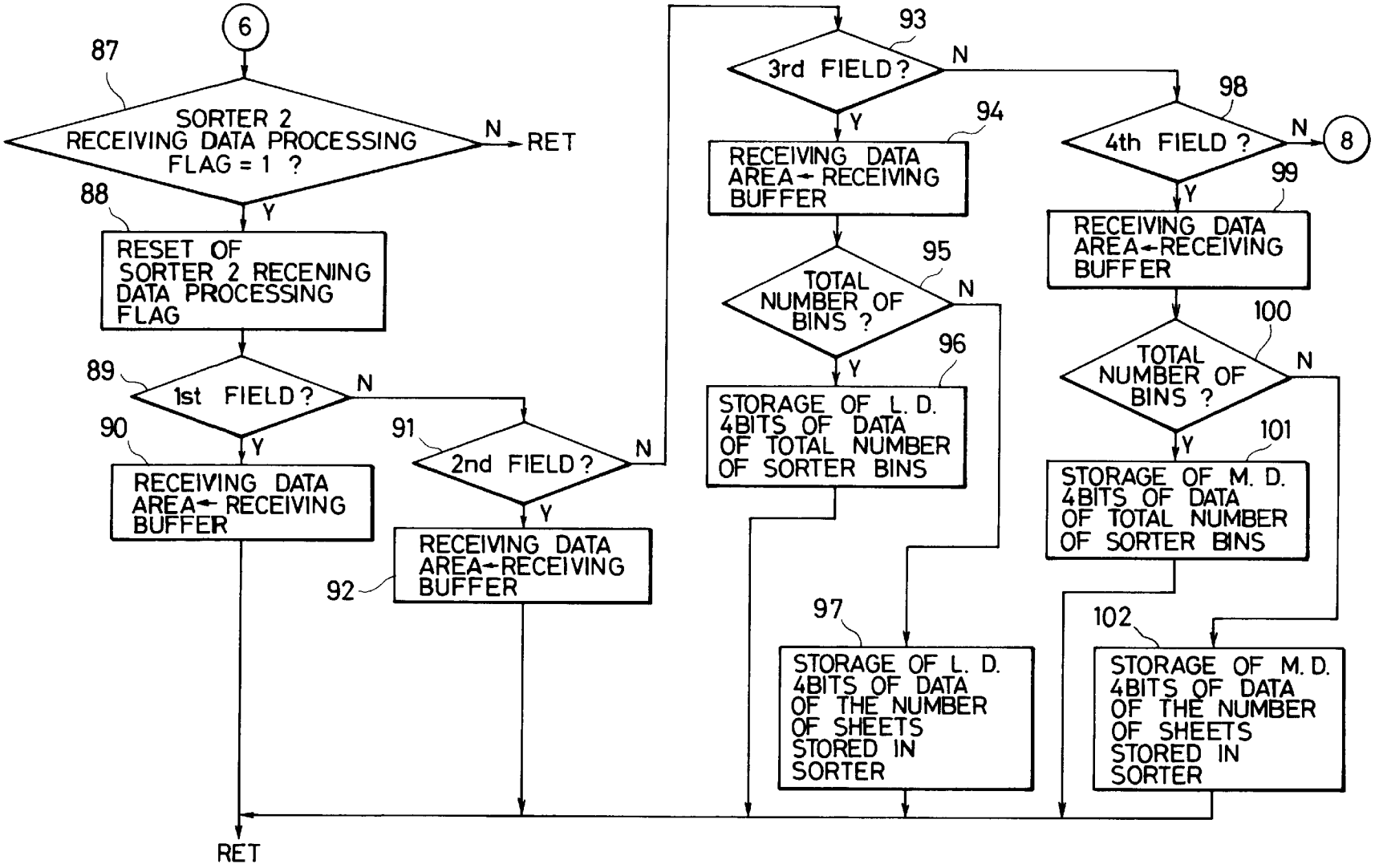
Figures 7, 8:
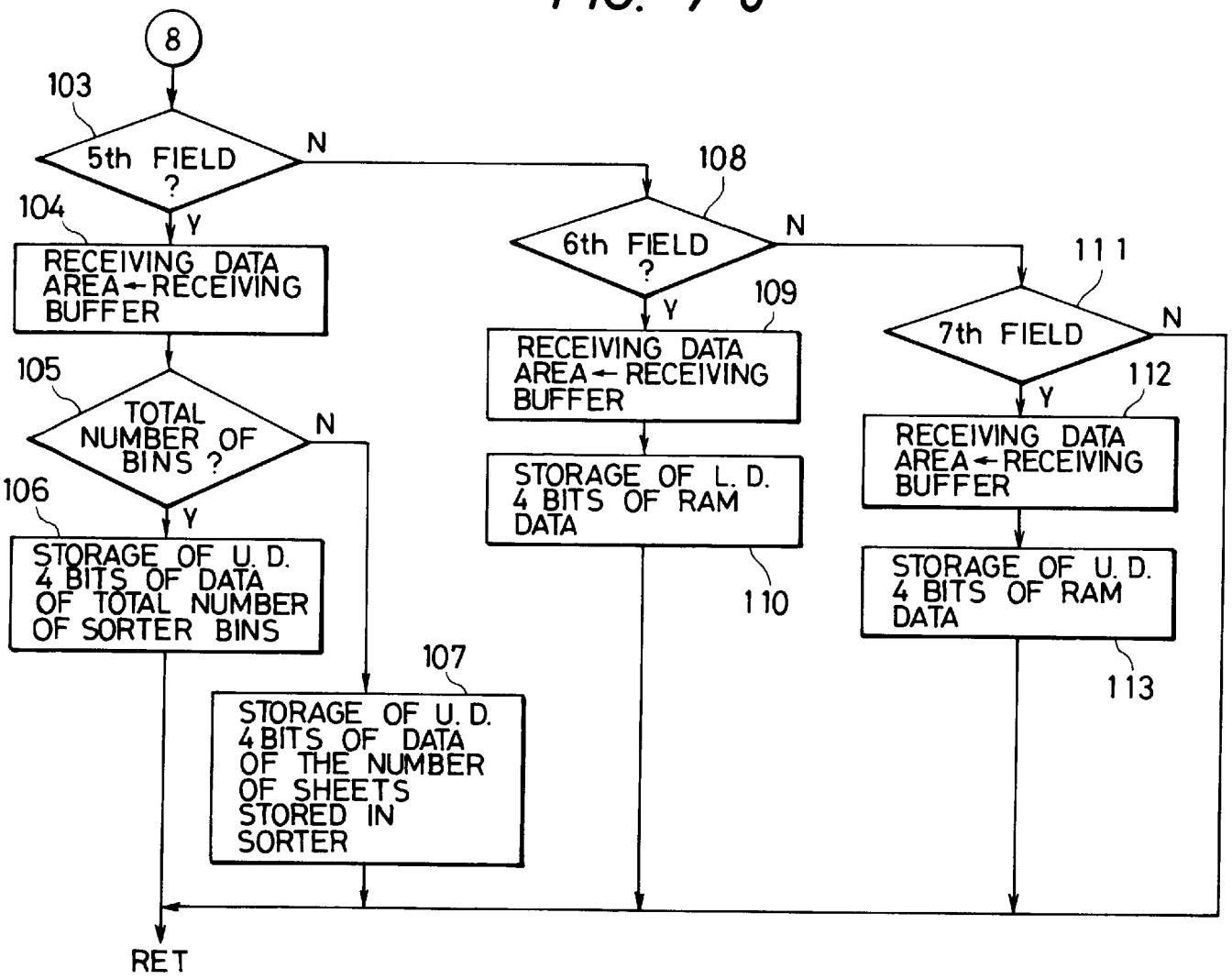
Figures 7, 8, 9, 9A:
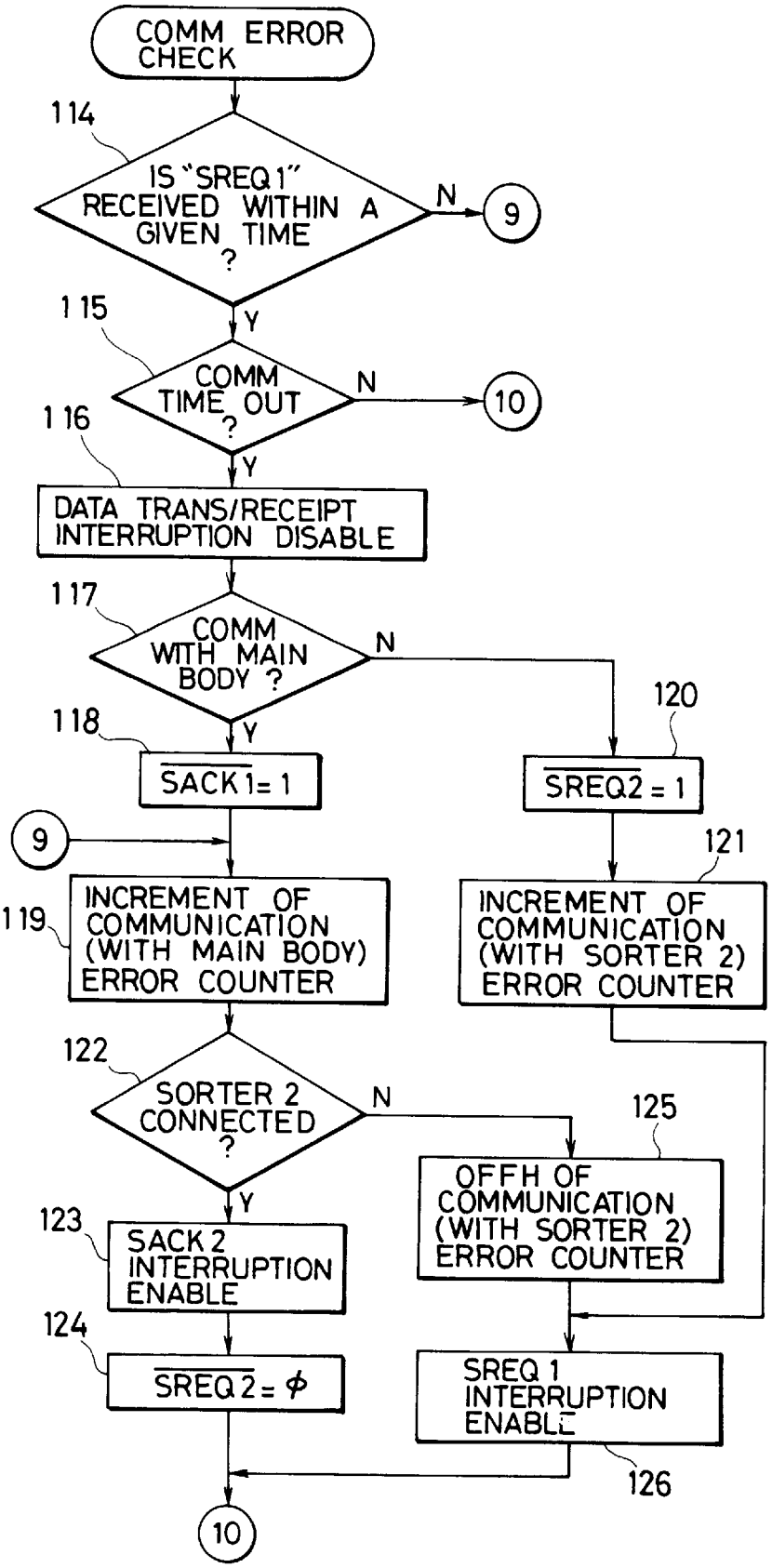
Figures 7, 8, 9, 9B:
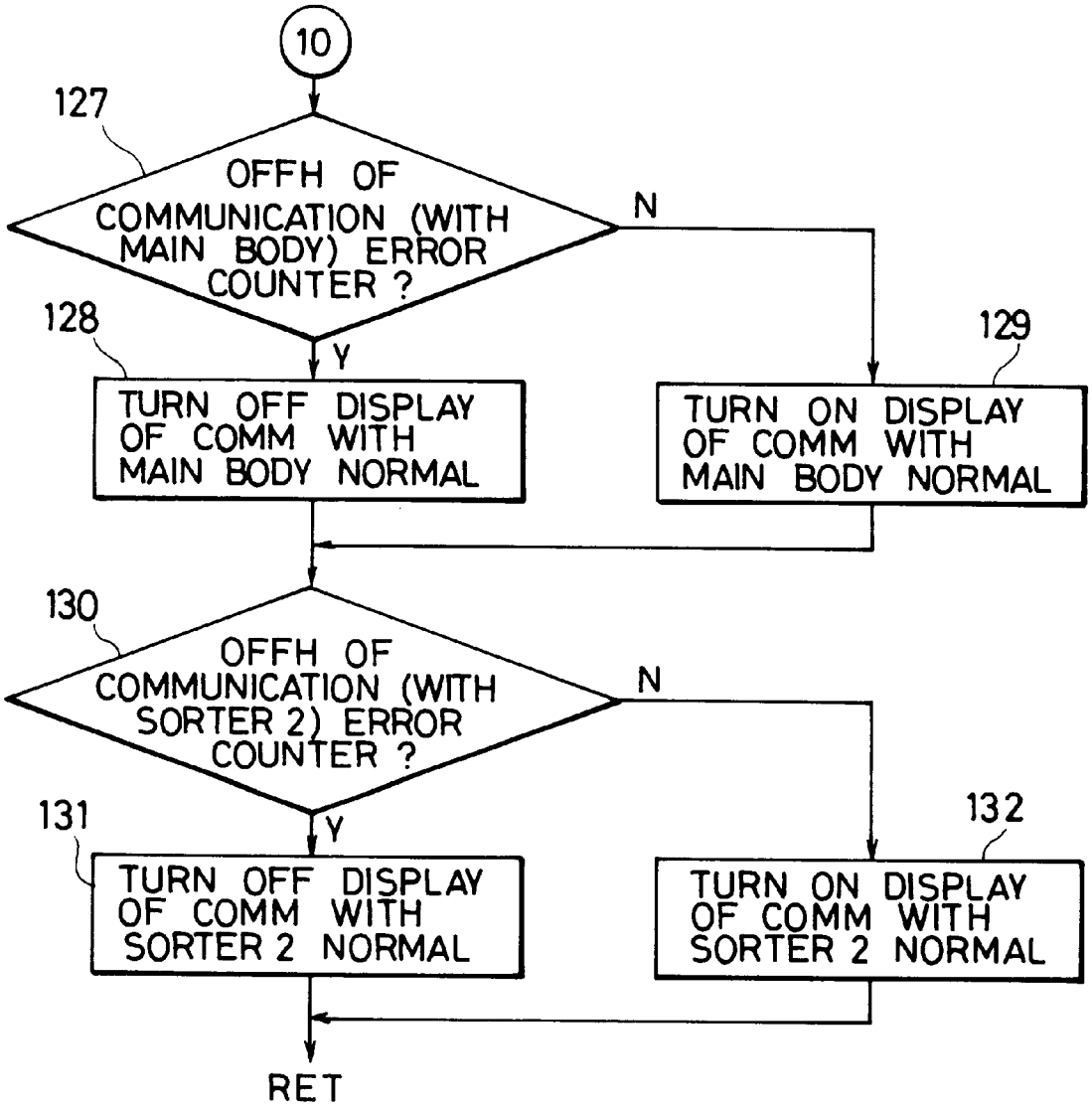
Figures 7, 8, 9, 10:
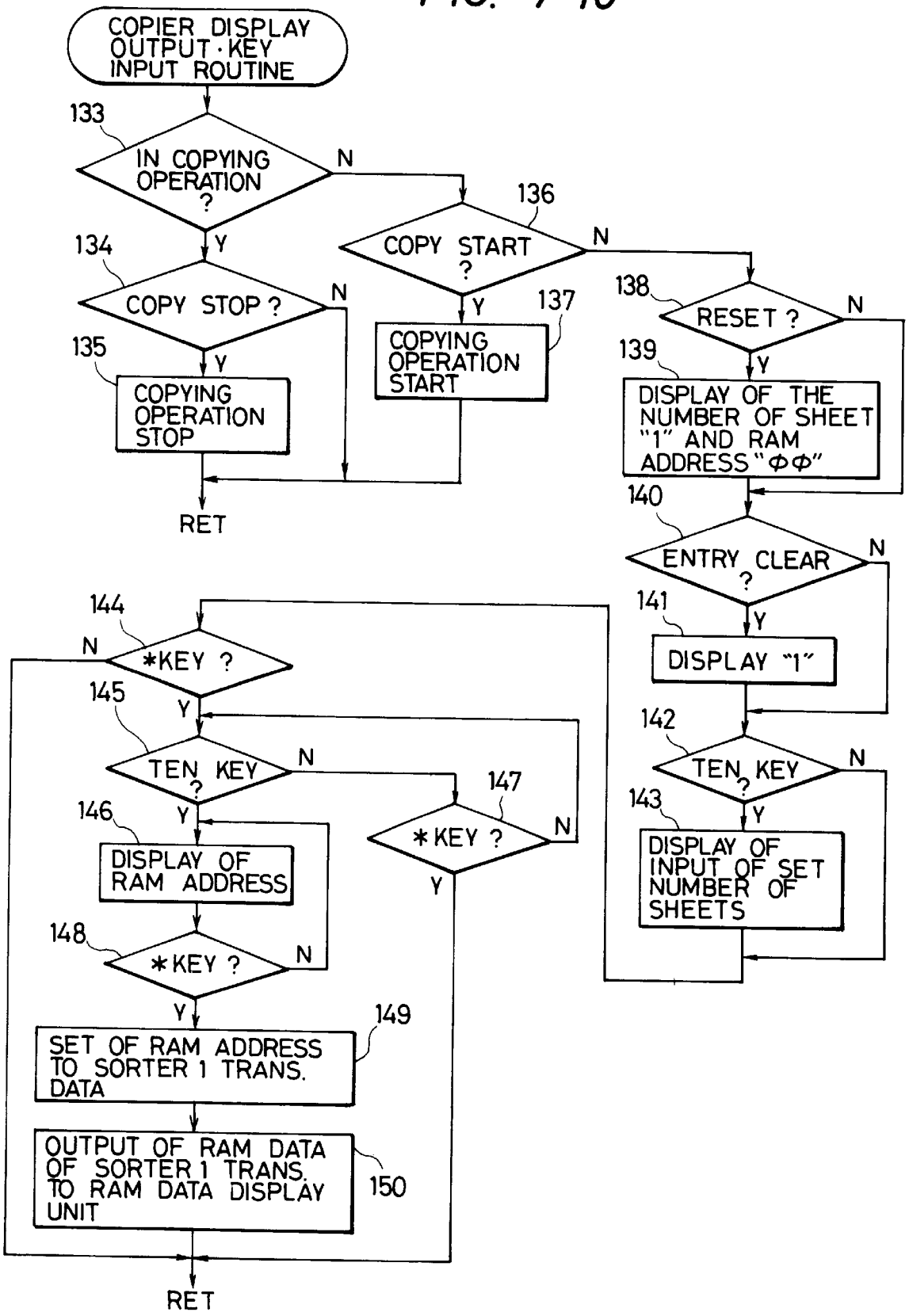
Figures 7, 8, 9, 10, 11:
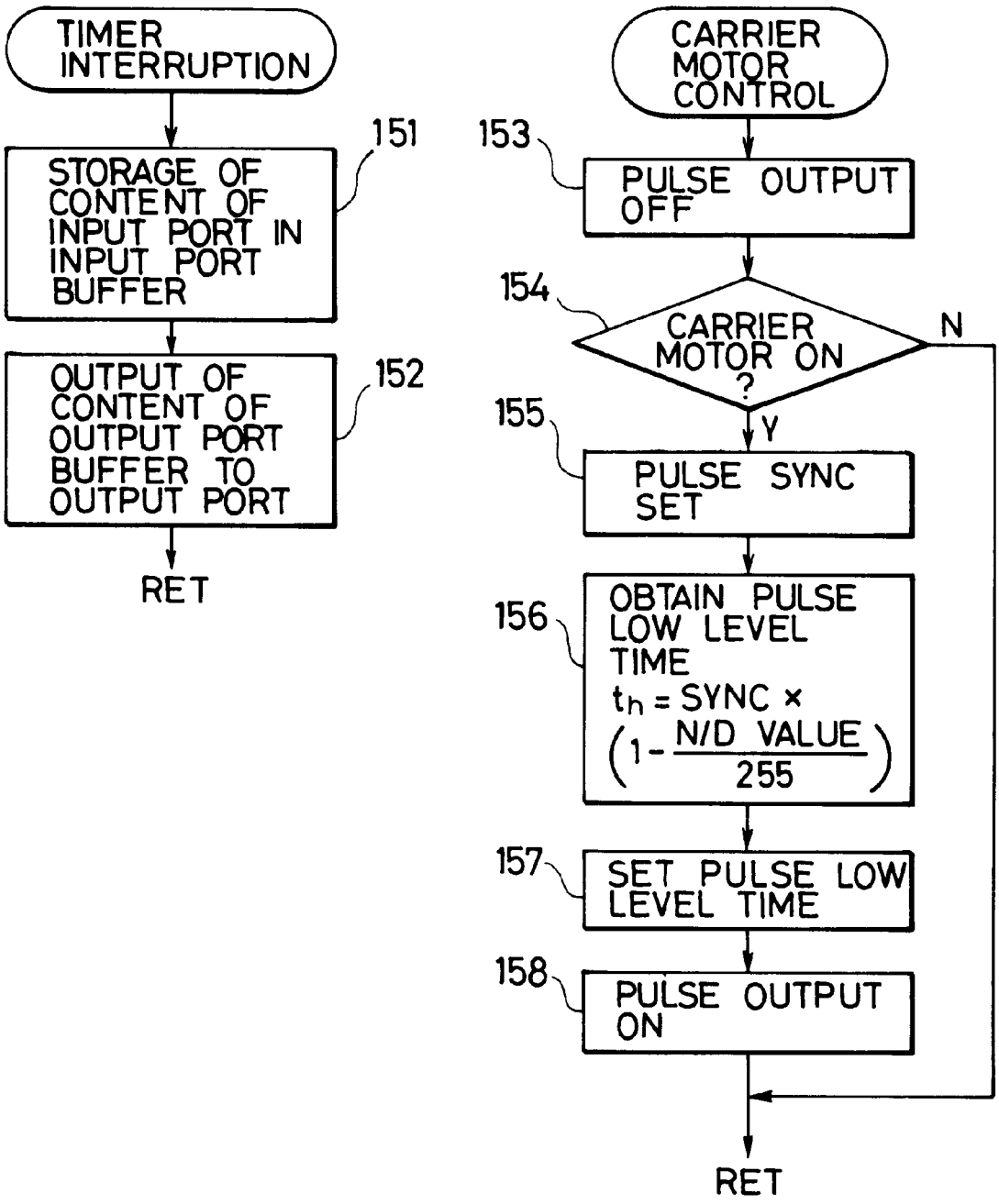
Figures 1, 8:
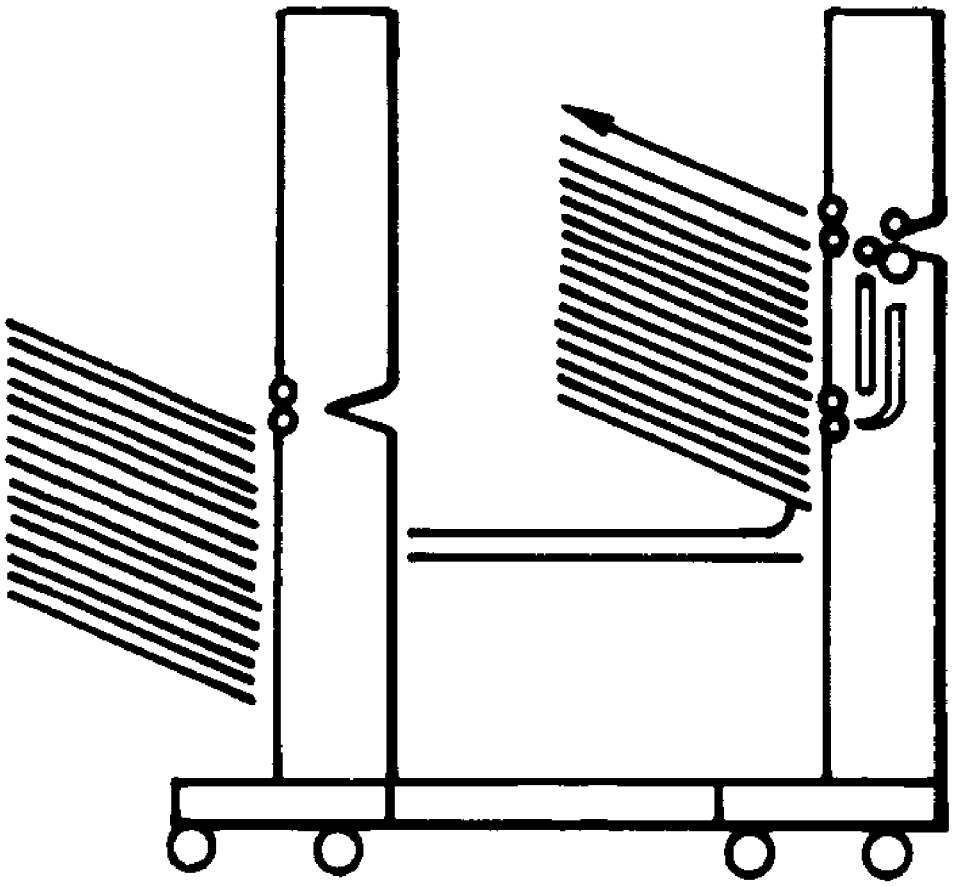
Figures 2, 8:
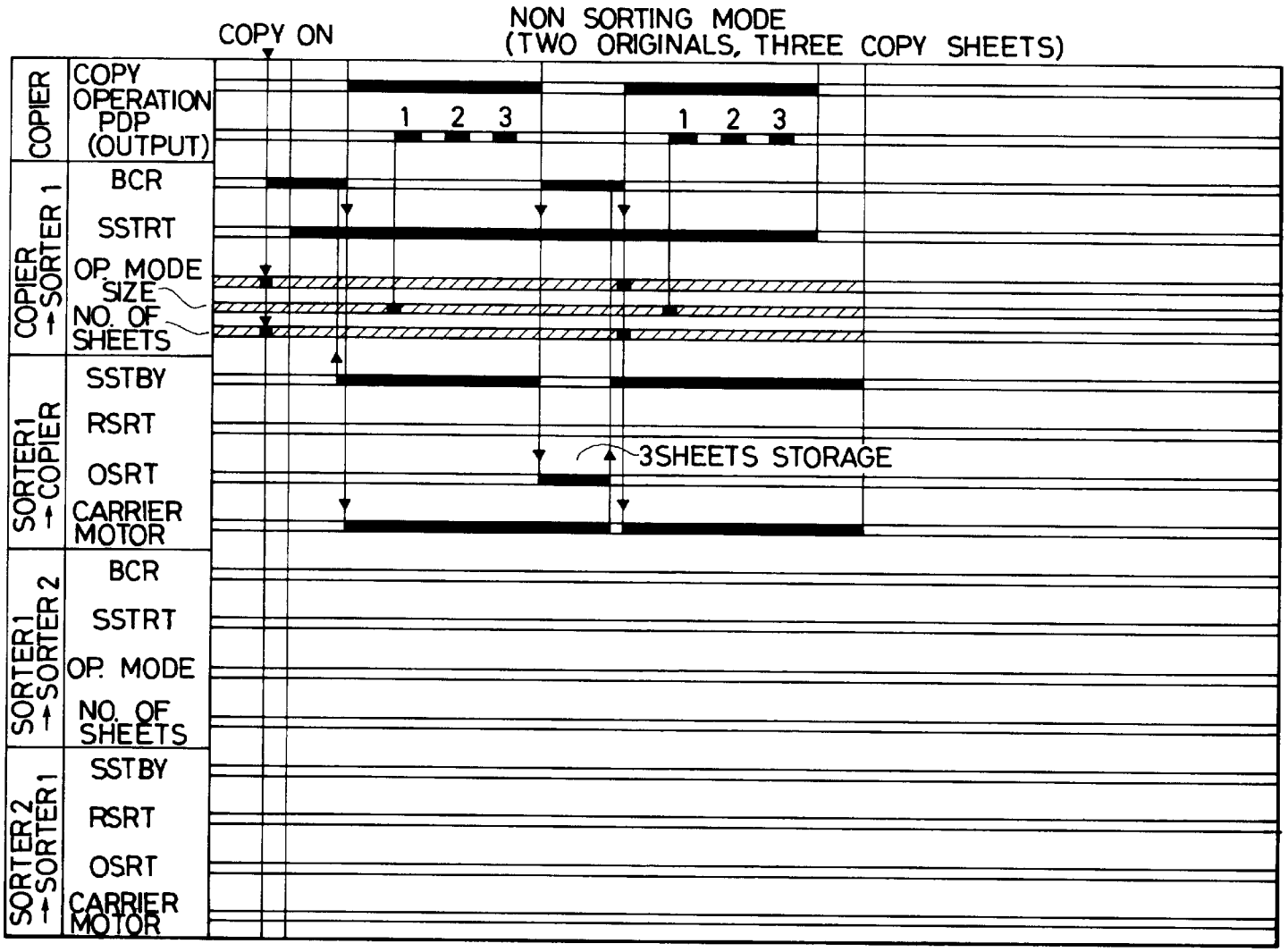
Figures 1, 9:
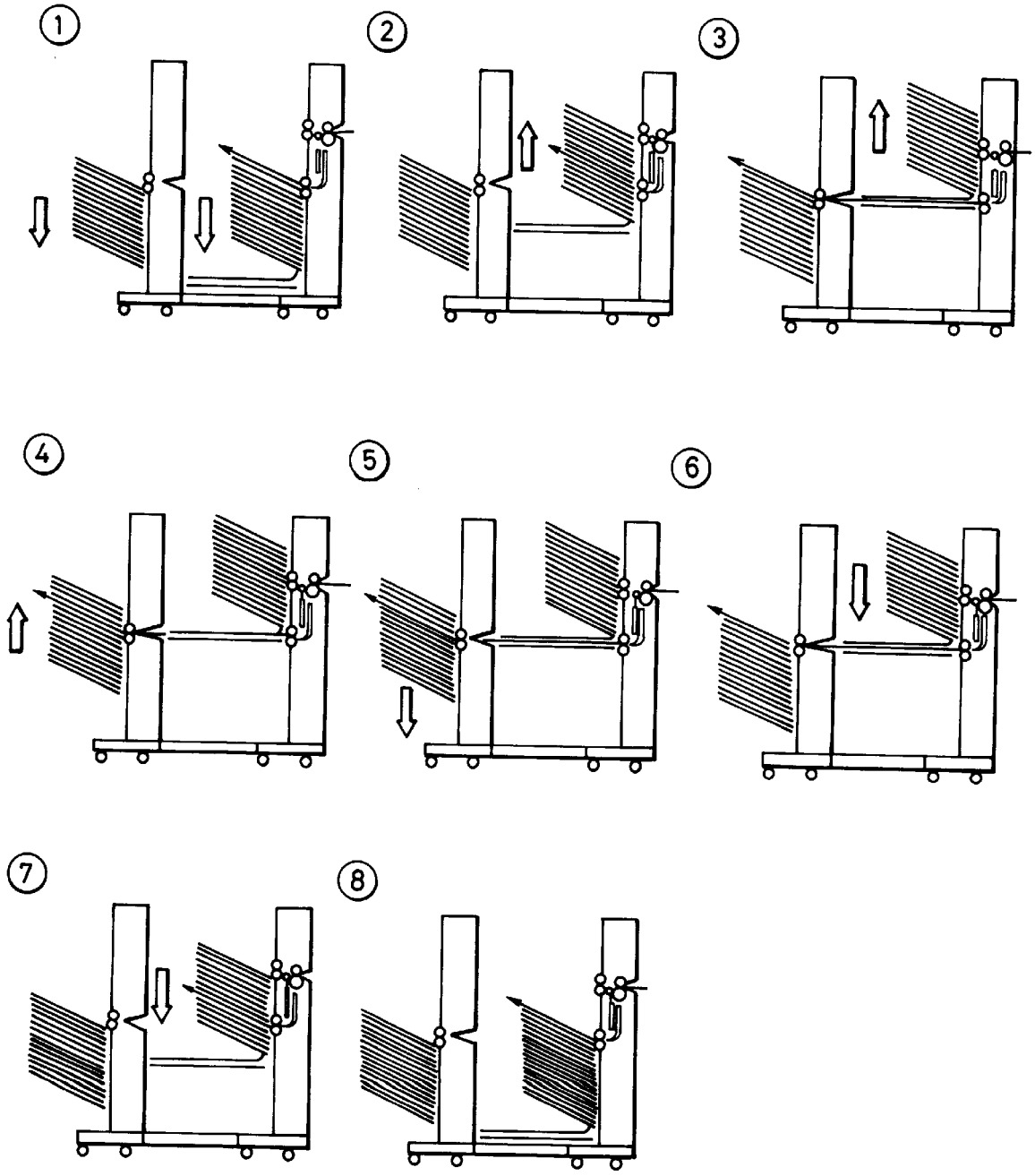
Figures 2, 9:
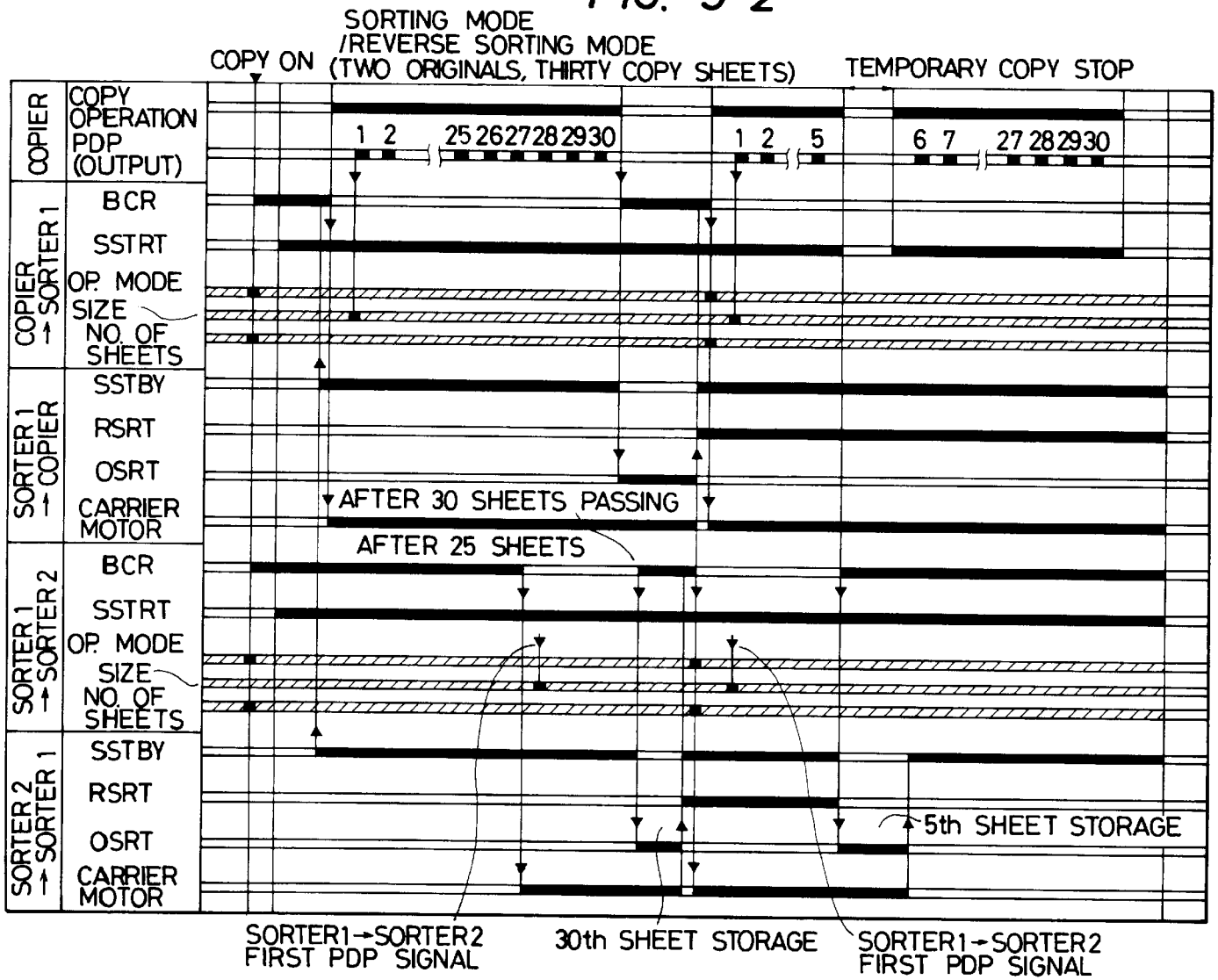
Figure 10:
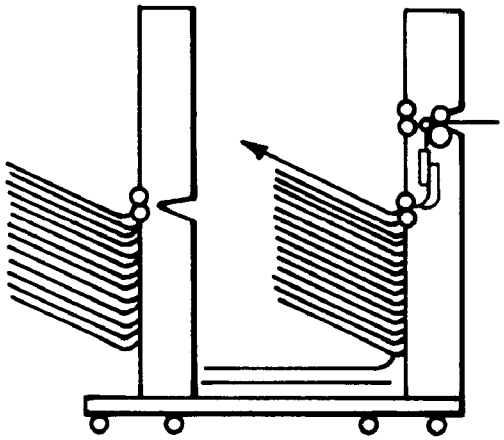
Figure 1:
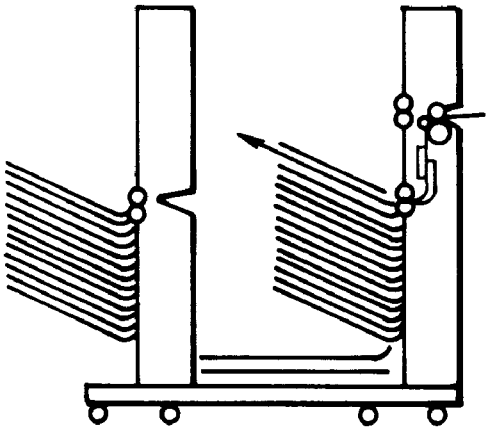
Figures 2, 10:
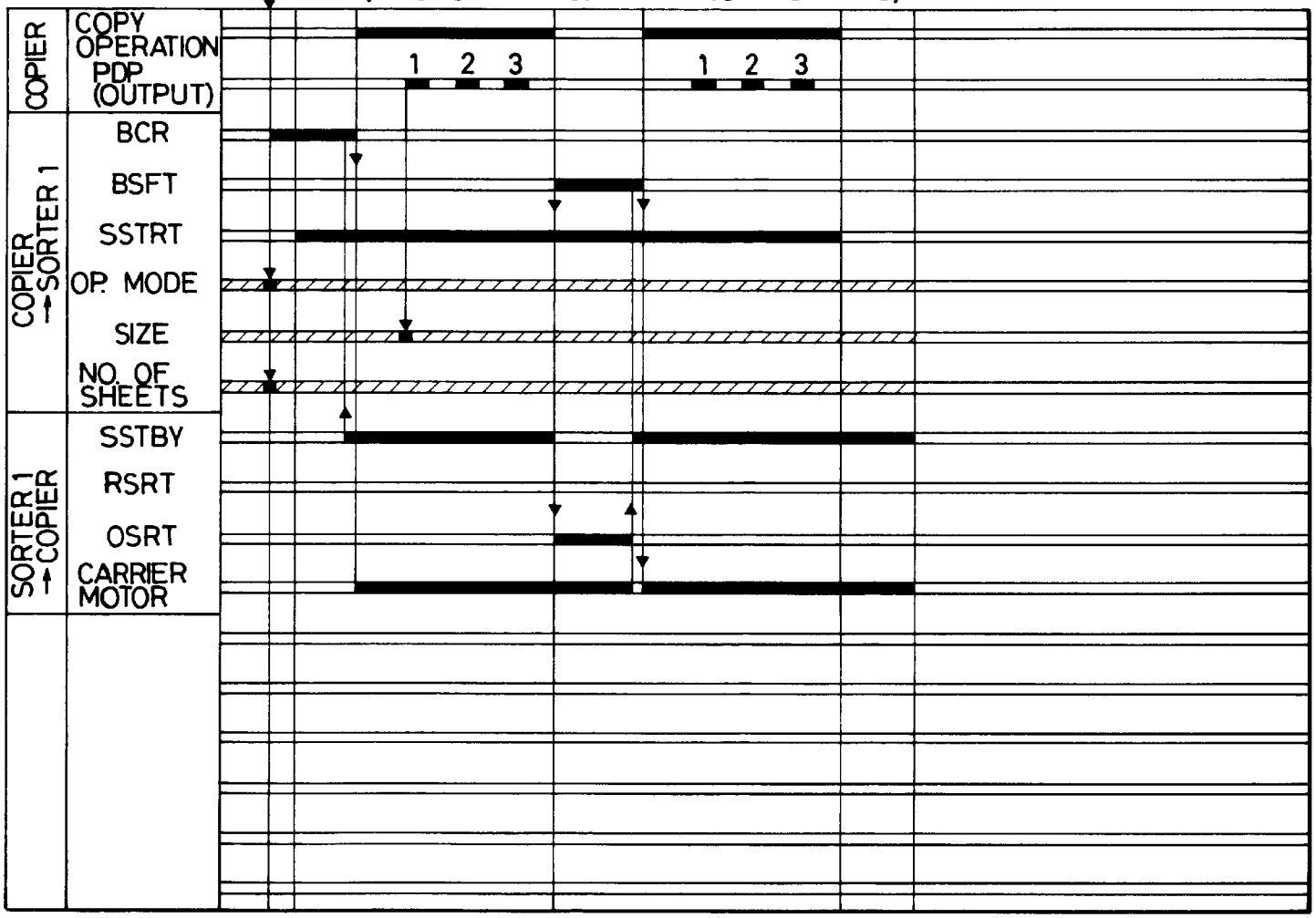

FIG.,9-2 is a timing chart of the sorting mode;

FIG. 10-1 is a schematic view showing the function of the sorter in a collating mode; and FIG. 10-2 is a timing chart of the collating mode.

DETAILED DESCRIPTION OF THE PREFERRED EMBODIMENTS

Now the present invention will be clarified in detail by embodiment thereof shown in the attached drawings.

As shown in FIG. 1, sheet sorters 19, 20, hereinafter referred to as sorters 1 and 2, respectively provided with plural bins, are connected to a copying machine 16. The sorter 1 is provided with 1st to 25th bins fixed in a bin frame 6, and the sorter 2 is provided with 26th to 50th bins likewise fixed in a bin frame 6, so that each sorter can sort 25 sheets. Also an automatic sheet feeder 21 is connected to the copying machine 16.

FIG. 2-1 is a block diagram showing the serial communication among the copying machine and the sorters. A control circuit of the copying machine displays, on a display unit, the number of copies are well as the preset number of copies entered by the operator through keys or the like, receive instructions of copy start/stop, and cassette size selection from an operation unit; and control the copying sequence automatic original feeder and sorter 1 through serial communication. A control circuit of the sorter 1 exchanges data with the copying machine and the sorter 2 through serial communication, displays various information on a display unit and performs sequence control of the sorter 1. A control circuit of the sorter 2 exchanges data with the sorter 1 through serial communication, displays various information on a display unit and performs sequence control of the sorter 2. There are further shown a serial communication request signal SREQ1 between the copying machine and the sorter 1; a serial communication start signal SACK1; serial communication lines SSOUT1, SSIN1 between the copying machine and the sorter 1; a sorter 1 connection signal SCNNT1; a sorter 1 remote power supply signal SON1; a serial communication request signal SREQ2 between the sorters 1 and 2; a serial communication start signal SACK2; serial communication lines SSOUT2, SSIN2 between the sorters 1 and 2; a sorter 2 connection signal SCNNT2; and a sorter 2 remote power supply signal SON2. After the start of power supply, the copying machine turns on the signal SON1, whereby the power supply to the circuit of the sorter 1 is turned on. Then the sorter 1 immediately turns on the signal SON2, whereby the power supply to the control circuit of the sorter 2 is turned on. After a period determined in consideration of the start characteristics of the power supplies of the sorters 1 and 2, the copying machine starts serial communication to the sorter 1.

Figures 2, 3, 4:
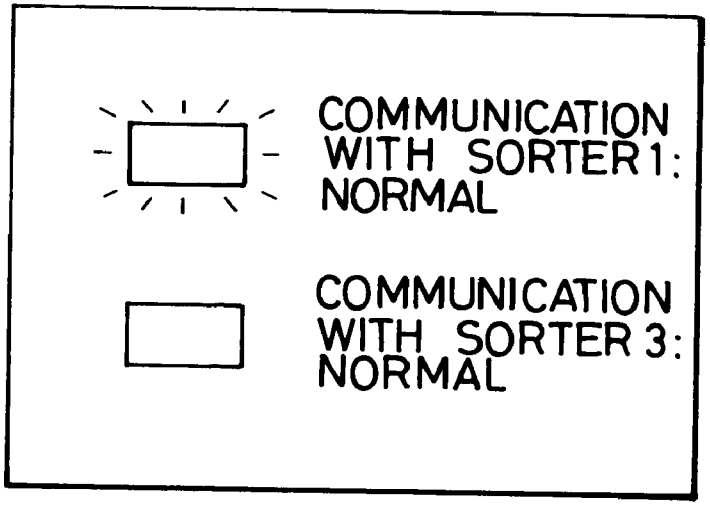
Figures 2, 3:
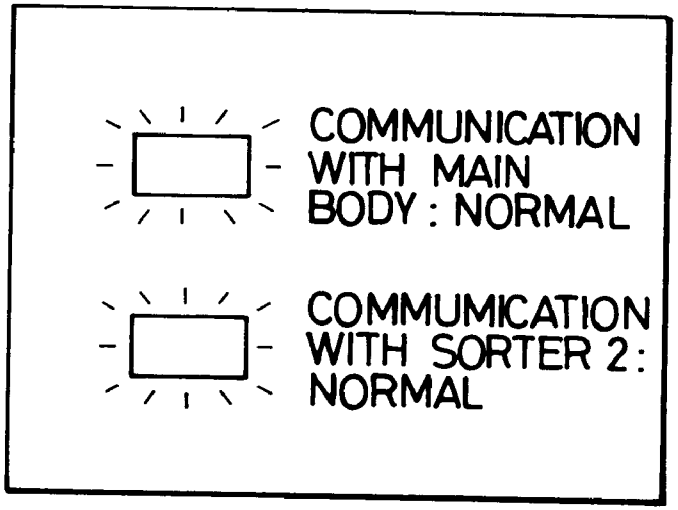
Figures 1, 3:
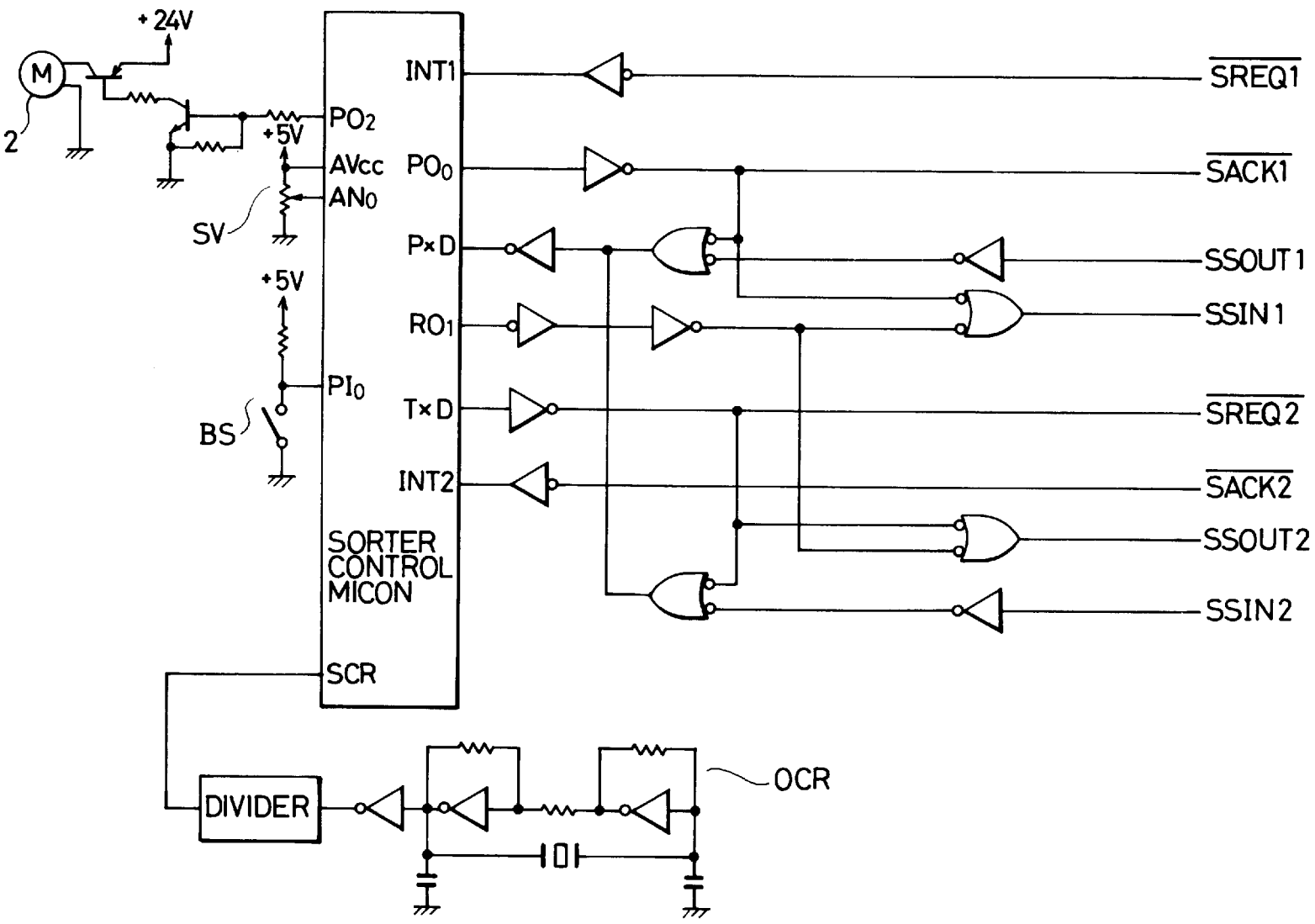
Figures 2, 3:
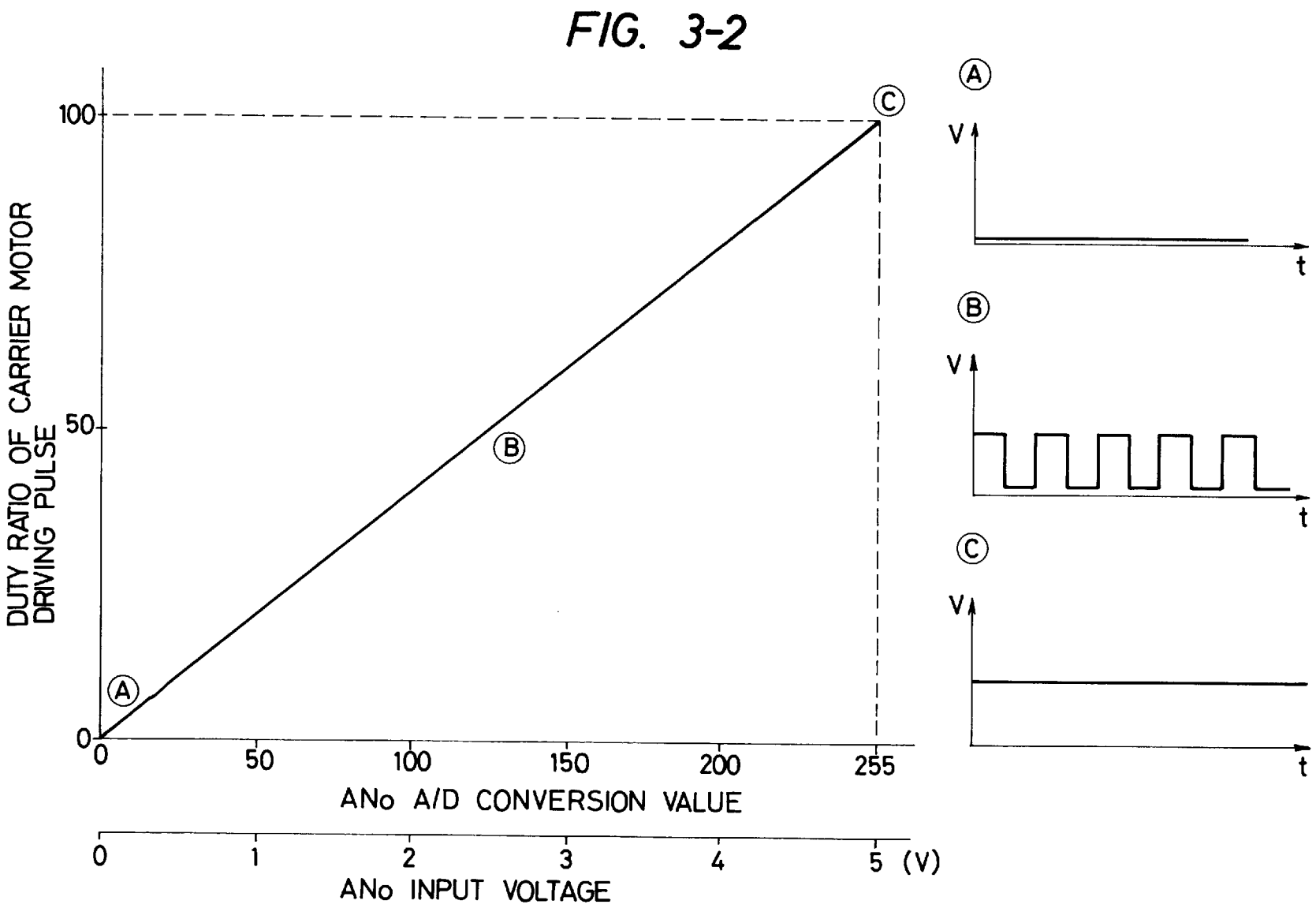
Figure 4:
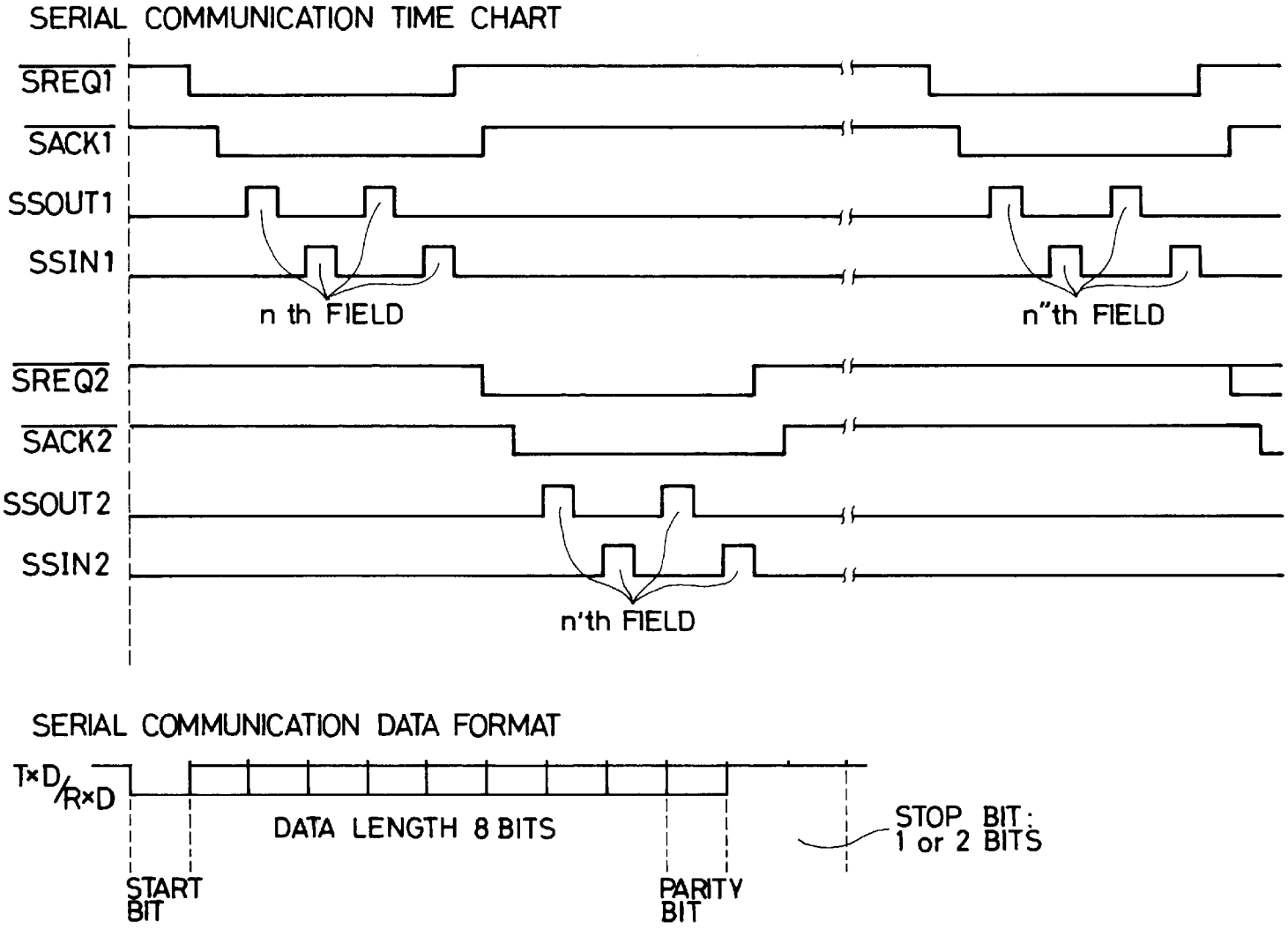

FIG. 3-1 shows an example of an interface circuit for serial communication of the sorter. The microcomputer for controlling the sorter can be composed of a one-chip microcomputer provided with an asynchronous serial interface function, a random access memory with back-up capability, an A/D converting function and a programmable square wave generating function, such as NEC $\mu$COM87AD. The rate of asynchronous serial communication, or baud rate, is determined by internal clock signals of the microcomputer and by output signals of an external clock generator OCR, which are selected by a baud rate selector switch BS provided in the microcomputer as shown in FIG. 3-1. It is therefore possible to select the serial communication with one of plural baud rates. In the asynchronous serial communication, a same baud rate has to be selected in the transmitting unit and in the receiving unit.

FIG. 3-1 also shows an example of a driving circuit for a transport motor of the sorter, wherein provided are a programmable square wave output port PO2; an A/D conversion reference voltage input port AVcc; and an A/D conversion input port AN0. A voltage set by a transport speed setting variable resistor SV is supplied to the port AN0, and pulse signals of a corresponding duty ratio are released from the port PO2 to drive a transport DC motor. In this manner the revolution of the transport motor is varied by the effective value of the applied voltage, to modify the transport speed.

FIG. 3-2 shows the relation between the voltage set by said variable resistor and the duty ratio of the pulse signals for driving the transport motor.

FIG. 4 is a chart showing the timing and data format of asynchronous serial communication. In a serial communication identical field data are sent and received twice, and compared, and the data are confirmed if compared field data are same. Then other field data are similarly sent twice in the next communication. On the other hand, if the data cannot be confirmed due to a certain error, same field data are sent again in the next communication.

FIGS. 5-1, 5-2, 6-1 and 6-2 show the structure of field data, name, meaning and function of control signals.

In the following there will be explained the procedure of serial communication, while making reference to the flow chart shown in FIG. 7-1.

After the start of power supply, the microcomputer of the sorter 1 initializes the random access memory and input/output ports, then performs the sequence control of the operation, check for error in the serial communication and data storage for serial communication, and awaits the entry of the request signal SREQ1 from the microcomputer of the copying machine (steps 1 to 4). Also a timer interruption routine is activated at a regular interval by an internal timer. Said routine stores the content of the input ports of the microcomputer, such as the input status of various sensors, in an input port buffer provided in the random access memory, and releases the content of an output port buffer, such as driving signals for various loads, provided in said random access memory RAM, to the output ports of the microcomputer (steps 151–152). Simultaneous with the start of serial communication, the microcomputer of the copying machine supplies the microcomputer of the sorter 1 with the request signal SREQ1, in response to which the latter microcomputer executes an SREQ1 interruption routine, which enables a data reception interruption routine, enables data reception and supplies the microcomputer of the copying machine with the signal SACK1 (steps 5–9). In response, said microcomputer transmits first transmission data to the microcomputer of the sorter 1. Upon reception of said first data, the microcomputer of the sorter 1 effects an internal interruption to execute the data reception interruption routine shown in FIGS. 7-2 and 7-3.

Said routine checks parity errors, identifies whether the received data contain an error code, and, if they are normal, temporarily stores said received data in a verification register provided in the RAM, and sets field data, identical with the received data, in a transmission register. On the other hand, if the received data are erroneous, it advances the count of a main communication error counter provided in the RAM, sets an error code in the transmission register, enables a data transmission interruption routine, and enables data transmission (steps 15–24). Upon completion of the first data transmission, the microcomputer of the sorter 1 executes the transmission interruption routine shown in FIG. 7-4, which enables a data reception interruption routine and enables data reception (steps 48–51). Upon receiving the first transmission data from the microcomputer of the sorter 1, the microcomputer of the copying machine performs an error check, and, in the absence of error, sends second data, identical with the first data, to the microcomputer of the sorter 1. Upon reception of said second data, the microcomputer of the sorter 1 effects an internal interruption to execute the data reception interruption routine.

Said routine checks parity errors, identifies whether the received data contain an error code, then identifies whether the received data are identical with the first data, and, if the received data are normal, stores the received data in the reception buffer provided in the RAM and sets second transmission data, identical with the first data, in the transmission register. On the other hand, if the received data are erroneous, it sets an error code in the transmission register, enables the data transmission interruption routine, and enables the data transmission (steps 15, 16,25–32).

Upon completion of the transmission of the second data, the microcomputer of the sorter 1 executes the data transmission interruption routine. After the second transmission, said routine sets a process flag for the data received from the main unit, stepwise decreases the content of the main unit communication error counter and turns off the SACK1 signal. In addition, if the sorter 2 is connected, it enables a SACK2 interruption routine for serial communication with said sorter 2, and turns on the SREQ2 signal. On the other hand, if the sorter 2 is not connected, it sets a sorter 2 communication error counter to OFFH for re-opening the serial communication with the microcomputer of the copying machine, and enables the SREQ1 interruption routine (steps 48, 49, 52–60).

In response to the SREQ2 signal from the microcomputer of the sorter 1, the microcomputer of the sorter 2 enables the data reception and turns on a signal SACK2. In response the microcomputer of the sorter 1 effects an internal interruption to execute the SACK2 interruption routine shown in FIG. 7-1, which sets field data to be transmitted in the transmission register, enables the data transmission interruption routine and enables the data reception (steps 10–14). Upon completion of the transmission of the first data, the microcomputer of the sorter 1 executes the data transmission interruption routine shown in FIG. 7-4, which enables the data reception interruption routine and enables the data reception (steps 48, 49, 52 and 61). Upon reception of the first data, the microcomputer of the sorter 2 checks errors, and, in the absence of errors, sends same field data to the microcomputer of the sorter 1.

Upon reception of the first data, the microcomputer of the sorter 1 effects an internal interruption to execute the data reception interruption routine, which checks parity errors, identifies whether the received data contains an error code, and, if the received data are normal, temporarily stores the receives data in the verification register provided in the RAM, sets data same as the first data in the transmission register, enables the data transmission interruption routine and enables the data transmission. On the other hand, if the received data are erroneous, it advances the count of a sorter 2 communication error counter provided in the RAM, turns of the SREQ2 signal and enables the SREQ interruption routine for the next serial communication (steps 33–38, 46 and 47).

Upon completion of the transmission of the second data, the microcomputer of the sorter 1 effects an internal interruption to execute the data transmission interruption routine, which enables the data reception interruption routine and enables the data reception (steps 48, 49, 52 and 61).

Upon reception of the second data, the microcomputer of the sorter 2 checks errors, and, in the absence thereof, sends data, identical with the first data, to the microcomputer of the sorter 1.

Upon reception of the second data, the microcomputer of the sorter 1 effects an internal interruption to execute the data reception interruption routine, which checks parity errors, identifies whether the received data contain an error code, and whether the received data are same as the first data, and, if the received data are normal, it stores the received data in the reception buffer provided in the RAM, sets a flag for the process for the data received from the sorter 2, turns off the SREQ2 signal to terminate the serial communication with the sorter 2 and enables the SREQ1 interruption routine for the next serial communication with the microcomputer of the copying machine. On the other hand, if the received data are erroneous, it advances the sorter 2 communication error counter, terminates the serial communication with the sorter 2 and enables the SREQ1 interruption routine for the next serial communication with the microcomputer of the copying machine (steps 39–47). Then a communication error routine in the main routine checks whether the communication has been completed within a determined time, and whether the communication error counter is in a count end state indicating an abnormality in the communication (step 3). The communication error check routine at first identifies whether the SREQ1 signal was received from the microcomputer of the copying machine within a determined time, and, if it was received within said determined time, proceeds to a step for identifying whether the serial communication was completed within a determined time.

If said signal was not received within said determined time, it advances the count of the main unit communication error counter and executes communication with the microcomputer of the sorter 2.

At first the routine discriminates whether the sorter 2 is connected, and, if connected, enables the SACK2 interruption routine and turns on the SREQ2 signal for serial communication with the microcomputer of the sorter 2. If the sorter 2 is not connected, it sets the sorter 2 communication error counter to OFFH, and enables the SREQ1 interruption routine for the next serial communication with the microcomputer of the copying machine. On the other hand, if the serial communication was not completed within the determined time, it disables the interruption for data transmission and reception, and discriminates whether the communication was with the microcomputer of the copying machine. If so, it turns off the SACK1 signal, then advances the count of the main unit communication error counter, and discriminates whether the sorter 2 is connected. If connected, the routine enables the SACK2 interruption routine and turns on the SREQ2 signal for serial communication with the microcomputer of the sorter 2. On the other hand, if the sorter 2 is not connected, it sets the sorter 2 communication error counter to OFFH, and enables the SREQ1 interruption routine for the next serial communication with the microcomputer of the copying machine. If the serial communication with the microcomputer of the sorter 2 is under way, the program turns off the SREQ2 signal, advances the count of the sorter 2 communication error counter and enables the SREQ1 interruption routine for the next serial communication with the microcomputer of the copying machine (steps 114–126). Then the communication error counters are checked. If the main unit communication error counter is in the count end state (OFFH), an error in the serial communication with the microcomputer of the copying machine is identified and a normal state display, indicating the status of communication with the main unit is turned off. In a similar manner, if the sorter 2 communication error counter is in the count end state (OFFH), an error in the serial communication with the microcomputer of the sorter 2 is identified and a normal state display, indicating the status of communication with the sorter 2 is turned off (steps 127–132).

Then the data received by the serial communication are processed in a serial communication data storage routine in the main routine (step 4), as shown in FIGS. 7-5 to 7-8. If the process flag for the data received from the main unit is set, said storage routine resets said flag and discriminates the field designation of the received data. If the 1st or 2nd field is designated, the received data are stored in a received data area provided in the RAM. In case the 3rd field is designated, the received data are stored in the received data area of the RAM, and, if they represent the preset number of copies, they replace lower 4 bits of 12-bit data indicating the preset number of copies, or, if not, they replace the size data. In case the 4th field is designated, the received data are stored in the received data area of the RAM, and, if they represent the preset number of copies, they replace the middle 4 bits of said 12-bit data. In case the 5th field is designated, the received data are stored in the received data area of the RAM, and, if they represent the preset number of copies, they replace upper 4 bits of said 12-bit data. In case the 6th field is designated, the received data are stored in the received data area of the RAM, and replace the lower 4 bits of an 8-bit RAM address. In case of 7th field, the received data are stored in the received data area of the RAM, and replace upper 4 bits of said 8-bit data (steps 62–76). The RAM addresses of the microcomputers of the sorter 1, accessible from the copying machine, are determined in advance (256 bytes from 0FF00H to 0FFFFH in the present embodiment), and lower 8 bits of 16-bit address are determined by the copying machine and transmitted in the serial communication. A same procedure is applied also to the sorters 1 and 2 (steps 62–76).

In case the process flag for data received from the sorter 2 is set, said storage routine resets said flag and discriminates the field designation of the received data. If the 1st or 2nd field is designated, the received data are stored in the received data area of the RAM. In case the 3rd field is designated, the received data are stored in the received data area of the RAM, and, if they represent the total number of bins, they replace the lower 4 bits of the 12-bit data indicating the total bin number, or, if not, they replace the lower 4 bits of 12-bit data indicating the number of sheets stored in the sorter. In case the 4th field is designated, the received data are stored in the received data area of the RAM, and, if they represent the total bin number, they replace the middle 4 bits of said 12-bit data indicating the total bin number, or, if not, they replace the middle 4 bits of said 12-bit data indicating the number of sheets stored in the sorter. In case the 5th field is designated, the received data are stored in the received data are of the RAM, and, if they represent the total bin number, they replace the upper 4 bits of said 12-bit data indicating the total bin number, or, if not, they replace the upper 4 bits of said 12-bit data indicating the number of sheets stored in the sorter. In case the 6th field is designated, the received data are stored in the received data area of the RAM, and they replace the lower 4 bits of 8-bit RAM data. In case the 7th field is designated, the received data are stored in the received data area of the RAM, and they replace the upper 4 bits of said 8-bit data. The above-mentioned data indicating the total bin number indicate the total number of bins available for sorting in the sorters. In the present embodiment, the sorter 2 transmits a bin number of 25 available for sorting to the sorter 1, which adds another bin number of 25 and transmits a total bin number of 50 to the copying machine. However, in case of a communication error between the sorters 1 and 2, the sorter 1 disregards the available bins of the sorter 2 and transmits the available bin number of 25 to the copying machine. The data indicating the number of sheets stored in the sorters are stored in a back-up area of the RAM. When the copying machine wants to know said number, for example for sheet number compensation after a sheet jamming in the copying machine or in the sorters, the copying machine provides the sorter 1 with a request signal, in response to which the sorter 1 provides the sorter 2 with a request signal. In response the sorter 2 transmits data indicating the number of sheets stored in the sorter 2 to the sorter 1, which then adds the number of sheets stored in the sorter 1 and sends the corresponding data to the copying machine. In this manner the copying machine can know the number of sheets stored in the sorters through serial communication. Thus, even if the power supply to the sorters is interrupted for resolving the sheet jamming, the copying machine can know the number of sheets stored in the sorters immediately before the sheet jamming and can correct the number of remaining copies. Said back-up area of the RAM also stores data of bin position. Consequently the bin position is retained even when the power supply is interrupted, so that a rapid movement of bins to the home position, is ensured. The above-mentioned RAM data are 8-bit data corresponding to a RAM address transmitted from the copying machine to the sorter 1 or from the sorter 1 to the sorter 2. In response to such transmitted RAM address, corresponding 8-bit RAM data are transmitted from the sorter 1 to the copying machine or from the sorter 2 to the sorter 1, and in this manner the copying machine or the sorter 1 can know the content of the RAM respectively of the sorter 1 or the sorter 2.

In the following there will be explained a display/key input routine in the microcomputer of the copying machine, shown in FIG. 7-10. At first, if a copying operation is under way, the routine discriminates whether a copy stop key has been actuated, and, if actuated, it terminates the copying operation, or, if not, it prohibits the entry of other keys to continue the copying operation (steps 133–135). On the other hand, if the copying operation is not under way, the routine checks various keys. At first if a copy start key has been actuated, the routine initiates a copy sequence and prohibits the actuation of other keys (steps 133, 136 and 137). If a reset key has been actuated, a copy number "1" and a RAM address "00" are supplied to the display unit. If a number clear key has been actuated, a copy number "1" is supplied to the display unit. If a numeral key has been actuated, the entry is accepted as a preset copy number and supplied to a set number display unit (steps 133, 136, 138–143). If a key "*" has been actuated, a following entry of a numeral key is identified as an input for a RAM address and supplied to the display unit. Upon repeated actuation of said key "*", the routine releases the input the RAM address, sets said RAM address in the 6th and 7th fields of the data to be transmitted to the sorter 1, and supplies, to a RAM data display unit, the RAM data in the 6th and 7th field of the data received from the sorter 1 (steps 144–150).

In the following there will be explained a transport motor control routine, shown in FIG. 7-11, for varying the transport speed by pulse drive of a transport motor of the sorter.

Said routine is activated in case of starting or stopping the transport motor 2 of the sorter. At first pulse signals are interrupted to discriminate whether the transport motor 2 is to be started or to be stopped, and, in the latter case, the routine is terminated.

On the other hand, if the transport motor 2 is to be started, the routine sets a pulse interval in an internal timer of the microcomputer, then sets a pulse low-level time, corresponding to the adjustment of the transport speed setting variable resistor SV in another internal timer of the microcomputer, and turns on the output of pulse signals, whereby the programmable square wave output port of the microcomputer releases a low-level signal, from the start of the pulse signals, for the pulse low-level time determined as explained above, and then a high-level signal for a period equal to the difference of pulse interval and said low-level time. This procedure is repeated until the pulse output is turned off (steps 153–158).

The sorters are controlled by the exchange of control signals through the above-described serial communication. In the following there will be explained the functions of the sorters, while making reference to FIGS. 8-1 to 9-2. The sorters can be operated in a non-sorting mode or a sorting mode (inverse sorting mode).

1. Non-sorting mode (case of making 3 copies from each of two originals):

In response to the actuation of the copy start key of the display-operation unit 17 of the copying machine 16, data for preset copy number (3 copies) and an operating mode (non-sorting mode) are transmitted by serial communication from said copying machine 16 to the sorter 119, and signals BCR, SSTRT are then transmitted. In response to said BCR signal, the sorter 119 moves the bins to a non-sorting home position. Upon completion of said bin movement, the sorter 119 sends a SSTBY signal to the copying machine 16, which, in response, turns off the BCR signal and enters a copying operation. In response to the turning off of the BCR signal, the sorter 119 shifts a sheet deflector 3 to the non-sorting side and activates the transport motor 2. During the passage of a sheet through a sheet discharge sensor 18 of the copying machine, a PDP signal is sent to the sorter 119, which activates a jam timer when said PDP signal is turned off, in order to inspect the arrival of sheet to a non-sorted sheet sensor 13 of the sorter 119. The bins are not elevated when the sheet arrives. After the determined number of sheets are discharged, the copying machine 16 sets the next original from the automatic original feeder 21 to an exposure position on a platen 17, then sends the data on the preset number of copies and operating mode (non-sorting mode) to the sorter 119, and finally sends the BCR and SSTRT signals.

In response to said BCR signal, the sorter 119 turns off the SSTBY signal, and sends an OSRT signal to the copying machine 16 until the last copy sheet prepared from the preceding original is finally stored in the sorter 119. Upon completion of said storage, the OSRT signal is turned off and the SSTBY signal is turned on. In response the copying machine 16 turns off the BCR signal and enters a copying operation on sheets fed in advance. Upon completion of the copying operation, the copying machine 16 discharges the original onto a tray, and turns off the SSTRT signal. In response to the turning off of said SSTRT signal, and after the third copy has passed the non-sorted sheet sensor 13, the sorter 119 turns off the SSTBY signal supplied to the copying machine 16, also turns off the transport motor 2 and shifts the sheet deflector 3 to the sorting position.

2. Sorting (inverse sorting) mode (case of making 30 copies from each of two originals: cf. FIGS. 9-1 and 9-2):

In response to the actuation of the copy start key of the display-operation unit 17 of the copying machine 16, data for preset copy number (30 copies) and an operating mode (sorting mode) are transmitted by serial communication from said copying machine 16 to the sorter 119, and signals BCR, SSTRT are then transmitted. In response to said BCR signal, the sorter 119 transmits, to another sorter 220, data of 5 sheets, which exceed the sorting capacity of 25 sheets of the sorter 119, and then transmits the BCR and SSTRT signals to the sorter 220. In response to said BCR signal, the sorters 119, 220 respectively move the bins to a sorting home position (cf. FIG. 9-1(1)). Upon completion of said bin movement, the sorter 220 transmits a SSTBY signal to the sorter 119. Also upon completion of the bin movement in the sorter 119 and in response to the SSTBY signal from the sorter 220, the sorter 119 sends a SSTBY signal to the copying machine 16, which in response turns off the BCR signal and enters a copying operation. In response to the turning off of the BCR signal, the sorter 119 activates the transport motor 2 and shifts the sheet deflector 3 to the sorting position. During the passage of a sheet through the sheet discharge sensor 18 of the copying machine, a PDP signal is sent to the sorter 119, which activates a jam timer, from the turning off of said PDP signal, in order to inspect the arrival of the sheet to a sorted sheet sensor 14 of the sorter 119. The sorter 119 activates a bin motor 5 to elevate the bins stepwise for each sheet passing said sensor 14 (cf. FIG. 9-1(2)) until 25 sheets are detected by said sensor 14. After 25 sheets are stored in the sorter 119, it moves the bins to the position of a bridge 10 and turns off the BCR signal to the sorter 220, thereby activating the transport motor 2 thereof. A 26th sheet from the copying machine 16 is transported, through said bridge 10, to the sorter 220. Simultaneously the sorter 119 sends the PDP signal to the sorter 220, which in response activates a jam timer for detecting sheet jamming between the sorters 119 and 220 (cf. FIG. 9-1(3)). The sorter 220 activates the bin motor 5 to stepwise elevate the bins for each of 26th to 29th sheets passing the sheet sensor 14 (cf. FIG. 9-1(4)). When the 30th sheet is sent to the sorter 220, further elevation of the bins is prohibited since the number of sheets (5) sent from the sorter 119 coincides with the number of sheets sorted in the sorter 220. After discharging the determined number of sheets, the copying machine 16 sets the next original from the automatic original feeder 21, then transmits the data on the preset number of copies and operating mode (sorting mode) to the sorter 119, and finally the BCR and SSTRT signals. In response the sorter 119 turns off the SSTBY signal and transmits an OSRT signal to the copying machine 16 until the last sheet prepared from the preceding original is finally stored in the sorter 220. When said last sheet passes the sorter 119, it supplies the sorter 220 with the number of remaining sheets to be sorted and the operating mode (sorting mode), and then sends the BCR and SSTRT signals. After sending the number of remaining sheets to the sorter 220, the sorter 119 shifts to the inverse sorting mode, based on a fact that the number of received sheets coincides with the preset number of copies, that the bins are placed at the position of bridge 10, and that the SSTRT signal is continued. Until the last sheet corresponding to the preceding original is stored, the sorter 220 turns off the SSTBY signal and sends the OSRT signal to the sorter 119. Upon storage of said last sheet, the sorter 220 shifts to the inverse sorting mode, based on a fact that the bins are located at the 5th bin position, that the number of sheets (5) stored in the sorter coincides with the preset number of copies for the succeeding original, and that the SSTRT signal is continued. Thus the sorter 220 turns off the OSRT signal and sends the SSTBY and RSRT signals to the sorter 119. In response to said SSTBY signal, the sorter 119 confirms the inverse sorting mode of the sorter 119 and sends the SSTBY and RSRT signals to the copying machine. In response the copying machine enters a copying operation on sheets fed in advance and the sorting operation is started from the sorter 220. The sorter 220 lowers the bins stepwise for each sheet stored (cf. FIG. 9-1(5)). After preparing copies of the excessive number (5), and in the presence of the RSRT signal from the sorter 119, the copying machine 16 interrupts the copying operation for a determined period, exceeding a sum of a time required by a sheet to pass the bridge 10 and to be stored in the sorter 220 and a time required for bin movement in the sorter 119 from the bridge to the 25th bin, thereby completely sending the 5th sheet to the sorter 119. Upon sending said 5th sheet to the bridge 10, the sorter 119 sends the BCR and SSTRT signals to the sorter 220. In response to said BCR signal, the sorter 220 turns on the OSRT signal and turns off the SSTBY signal until the sheet on the bridge 10 is completely stored. Also in response to said BCR signal, the sorter 220 shifts from the inverse sorting mode to the sorting mode. Since the bins are located at the sorting home position, the OSRT signal is reset and the SSTBY signal is sent to the sorter 119 upon storage of said 5th sheet. After sending said BCR and SSTRT signals, the sorter 119 prohibits the bin movement until the OSRT signal from the sorter 220 is turned off. After said turning off, the sorter 119 shifts the bins to the 25th bin position and activates the bin motor 5 to stepwise lower the bins for each of 6th to 30th sheets (cf. FIG. 9-1 (6), (7)). Upon completion of the copying operation, the copying machine 16 discharges the original to the tray of the automatic original feeder 21 and turns off the SSTRT signal to the sorter 119. After the 30th sheet passes the sheet sensor 14, the sorter 119 turns off the RSRT and SSTBY signals to the copying machine 16 and deactivates the transport motor 2.

3. Collating mode (case of making 3 copies from each of two originals) (cf. FIG. 10-1 and 10-2):

In response to the actuation of the copy start key of the display-operation unit 17 of the copying machine 16, data for preset copy number (3 copies) and an operating mode (collating mode) are transmitted by serial communication from said copying machine 16 to the sorter 119, and signals BCR, SSTRT are then transmitted. In response to said BCR signal, the sorter 119 moves the bins to a sorting home position (cf. FIG. 10-1(1)). Upon completion of said bin movement, the sorter 119 sends a SSTBY signal to the copying machine 16, which in response turns off the BCR signal and enters a copying operation. On the other hand, in response to the turning off of the BCR signal, the sorter 119 shifts the sheet deflector 3 to the sorting position and activates the transport motor 2. During the passage of a sheet through the sheet discharge sensor of the copying machine, a PDP signal is sent to the sorter 119, which activates a jam timer, in response to the turning off of said PDP signal, to inspect the arrival of the sheet to the sorted sheet sensor 14 of the sorter 119. After discharging the determined number of copies, the copying machine set the next original from the automatic original feeder 21, then sends data on the preset number of copies and an operating mode (collating mode) to the sorter 119, and releases BSFT and SSTRT signals. In response to said BSFT signal, the sorter 119 turns off the SSTBY signal, and sends an OSRT signal to the copying machine 16 until the last copy sheet prepared from the preceding original is completely stored in the sorter 119. Upon completion of said storage, the OSRT signal is turned off and the SSTBY signal is turned on. In response to said SSTBY signal the copying machine 16 turns off the BSFT signal and enter a copying operation on sheets fed in advance. After the confirmation of turning off of the BSFT signal, the sorter 199 elevates the bins by one step (cf. FIG. 10-1(2)). Upon completion of the copying operation, the copying machine 16 discharges the original to the tray of the automatic original feeder 21, and turns off the SSTRT signal. In response to the turning off of the SSTRT signal and after the 3rd copy passes the sheet sensor 14, the sorter 119 turns off the SSTBY signal to the copying machine 16 and deactivates the transport motor 2.

Though the foregoing embodiment has been limited to an application to a sorter as an example of sheet handling apparatus, the present invention is not limited to such embodiment but is applicable to other apparatus such as automatic original feeder, stapler, folder or the like.

In the foregoing embodiment an exclusive display unit is provided for displaying the address and data of RAM, but other display units, for example for displaying copy number, may be utilized for this purpose.

Also the present invention is applicable to certain apparatus with plural microcomputers among which data communication is effected.

What is claimed is:

1. A sheet sorting apparatus comprising:

a first sheet sorting unit comprising first processing means with a plurality of storage bins for processing a sheet and first control means for controlling said first processing means;

a second sheet sorting unit, connected to said first sheet sorting unit, comprising second processing means with a plurality of storage bins for processing a sheet and second control means for controlling said second processing means, wherein said first control means and said second control means each includes input and output means for asynchronous serial communication between them to receive/transmit data on available storage bins at a data transmission rate; and selecting means adapted to select the data transmission rate for the asynchronous serial communication.

2. A sheet sorting apparatus according to claim 1, wherein each of said first control means and said second control means comprises a microcomputer.

3. A sheet sorting apparatus according to claim 2, wherein said second sheet sorting unit is adapted to sort and store the sheets transported in excess of the processing capacity of said first processing means.

4. A sheet sorting apparatus according to claim 2, wherein said first sheet sorting unit further comprises designating means for designating the address of a memory of said second control means and the content of the address designated by said designating means is displayed on a display.

5. A sheet sorting apparatus according to claim 1, wherein said selecting means is adapted to select whether the data transmission rate for the asynchronous serial communication is determined by internal clock signals of a microcomputer of said first control means or by an external clock.

6. A sheet sorting apparatus according to claim 1, wherein said first sheet sorting unit is connected to an apparatus having recording means for image recording on sheets, and said second processing means receive from said first sheet sorting unit the sheets recorded on by the recording means and sorts and stores the sheets.

* * * * *

UNITED STATES PATENT AND TRADEMARK OFFICE

CERTIFICATE OF CORRECTION

PATENT NO. : 5,903,284

DATED : May 11, 1999

INVENTOR(S) : SHUNJI SATO

It is certified that error appears in the above-identified patent and that said Letters Patent is hereby corrected as shown below:

COLUMN 1,
Line 46, "efficiency." should read --office efficiency.--; and
Line 55, "a" should be deleted.

COLUMN 3,
Line 25, "FIG., 9-2" should read --FIG. 9-2--.

COLUMN 7,
Line 45, "lower" should read --the lower--, and "12-bit" should read --the 12-bit--;
Line 56, "of 7th field," should read --the 7th field is designated,--; and
Line 57, "upper" should read --the upper--.

COLUMN 12,
Line 28, "enter" should read --enters--.

COLUMN 14,
Line 8, "receive" should read --receives--.

UNITED STATES PATENT AND TRADEMARK OFFICE

CERTIFICATE OF CORRECTION

PATENT NO. : 5,903,284

DATED : May 11, 1999

INVENTOR(S) : SHUNJI SATO

It is certified that error appears in the above-identified patent and that said Letters Patent is hereby corrected as shown below:

FIGURE 7-7,
"RECENING" should read --RECEIVING--.

Signed and Sealed this

Twenty-third Day of November, 1999

*Attest:*

Q. TODD DICKINSON

*Attesting Officer*

*Acting Commissioner of Patents and Trademarks*